US006491378B2

(12) United States Patent
Fujii et al.

(10) Patent No.: US 6,491,378 B2
(45) Date of Patent: Dec. 10, 2002

(54) INK JET HEAD, INK JET PRINTER, AND ITS DRIVING METHOD

(75) Inventors: Masahiro Fujii, Shiojiri (JP); Hiroyuki Ishikawa, Shiojiri (JP); Yasushi Matsuno, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/754,533

(22) Filed: Jan. 4, 2001

(65) Prior Publication Data

US 2001/0007460 A1 Jul. 12, 2001

Related U.S. Application Data

(63) Continuation-in-part of application No. 09/601,833, filed as application No. PCT/JP99/06816 on Dec. 6, 1999.

(30) Foreign Application Priority Data

| | | |
|---|---|---|
| Dec. 8, 1998 | (JP) | 10-348699 |
| Dec. 24, 1998 | (JP) | 10-367499 |
| May 31, 1999 | (JP) | 11-152261 |
| Jan. 6, 2000 | (JP) | 2000-000646 |

(51) Int. Cl.[7] ..... B41J 2/06
(52) U.S. Cl. ..... 347/54
(58) Field of Search ..... 347/54, 68, 69, 347/70, 71, 72, 50, 40, 20, 44, 47, 27, 63; 399/261; 361/700; 310/328–330; 29/890.1

(56) References Cited

U.S. PATENT DOCUMENTS

| | | | |
|---|---|---|---|
| 4,973,980 | A | 11/1990 | Howkins et al. |
| 5,513,431 | A | 5/1996 | Ohno et al. |
| 5,534,900 | A | 7/1996 | Ohno et al. |
| 5,894,316 | A | 4/1999 | Sakai et al. |
| 5,912,684 | A | 6/1999 | Fujii et al. |
| 6,113,218 | A | 9/2000 | Atobe et al. |
| 6,117,698 | A | 9/2000 | Atobe et al. |
| 6,120,124 | A | 9/2000 | Atobe et al. |

FOREIGN PATENT DOCUMENTS

| | | |
|---|---|---|
| EP | 0 307 160 | 3/1989 |
| EP | 0 738 600 A2 | 10/1996 |
| EP | 0 795 776 A1 | 9/1997 |
| EP | 0 829 354 A1 | 3/1998 |
| JP | 1-157861 | 6/1989 |
| JP | 4-369542 | 12/1992 |
| JP | 5-50601 | 3/1993 |
| JP | 6-70882 | 3/1994 |
| JP | 8-72240 | 3/1996 |
| JP | 8-290567 | 11/1996 |
| JP | 9-30007 | 2/1997 |
| JP | 9-39228 | 2/1997 |
| JP | 9-39229 | 2/1997 |
| JP | 9-39235 | 2/1997 |
| JP | 9-39236 | 2/1997 |
| JP | 9-230318 | 9/1997 |
| JP | 9-254381 | 9/1997 |
| JP | 9-258246 | 10/1997 |
| JP | 9-314837 | 12/1997 |
| JP | 10-304685 | 11/1998 |
| WO | 97/32728 | 9/1997 |

*Primary Examiner*—Raquel Yvette Gordon
(74) *Attorney, Agent, or Firm*—Michael T Gabrik

(57) ABSTRACT

In an ink jet head that reduces failure or abnormality in ink ejection, electric charge/discharge is applied between opposed electrodes and diaphragms to eject ink droplets from ink nozzles. Each of the opposed electrodes includes a main electrode and a sub-electrode formed on the nozzle side and in common with sub-electrodes for the other diaphragms. Auxiliary electric charge is applied between the sub-electrode and the diaphragms so that the menisci or ink in the ink nozzles vibrate without ejecting unnecessary ink droplets and to shorten the time for tail portions of ejected ink columns to leave the ink nozzles. Ink in ink channels is diffused so that the ink viscosity does not increase due to evaporation of ink solvent. Also, the menisci in the nozzles are drawn into the ink chambers so that unnecessary ink droplets are not ejected immediately after printing ink droplets are ejected.

21 Claims, 28 Drawing Sheets

Fig. 38

| Steps | Details of steps | Manufacturing conditions |
|---|---|---|
| Step 1<br>Forming recess portions 9 on the glass substrate | Cr spattering | t = 1000 Å |
| | Resist coating/exposure/developing | Photomask 1 |
| | Cr etching | Etching agent of cerium nitrate/30°C/60sec. |
| | Resist stripping | Stripping solvent of sulfuric acid |
| | Glass etching | Etching agent of HF |
| | Cr stripping | Etching agent of cerium nitrate/30°C/60sec. |
| Step 2<br>Forming a Cr pattern | Cr spattering | t = 1500 Å |
| | Resist coating/exposure/developing | Photomask 2 |
| | Cr etching | Etching agent of cerium nitrate/30°C/60sec. |
| | Resist stripping | Stripping solvent of sulfuric acid |
| Step 3<br>Forming an ITO pattern | ITO spattering | t = 1000 Å |
| | Resist coating/exposure/developing | Photomask 3 |
| | ITO etching | Etching agent of aqua regia/40°C/10min. |
| Step 4<br>Bonding (AB) | Alignment | Alignment of silicon and glass substrates |
| | Anodic bonding | |

INK JET HEAD, INK JET PRINTER, AND ITS DRIVING METHOD

CROSS REFERENCE TO RELATED APPLICATION

This application is a continuation-in-part of U.S. application Ser. No. 09/601,833, filed on Aug. 7, 2000, which is a 371 of PCT/JP99/06816, filed Dec. 6, 1999, the contents of which are incorporated by reference herein.

BACKGROUND OF THE INVENTION

1. Field of the Invention

The present invention relates to an ink jet head which ejects ink droplets so as to make the ink droplets adhere onto recording paper only when recording is demanded; an ink jet printer thereof; and a method for driving the ink jet head. In particular, the present invention relates to the prevention of a failure or abnormality in ink ejection.

2. Description of the Related Art

Generally, an ink jet head has pressure build-up chambers for applying pressure to ink so as to eject ink droplets. Then, one end of each pressure build-up chamber communicates with an ink tank through an ink supply channel while the other end of the pressure build-up chamber is provided with an ink nozzle for ejecting an ink droplet. In addition, a bottom portion of the pressure build-up chamber is formed to be deformable and used as a diaphragm. This diaphragm is elastically displaced by electromechanically converting means so as to generate pressure for ejecting an ink droplet from the ink nozzle.

A printer using such an ink jet head has excellent features such as low noise, low power consumption, and so on, and it has come into wide use as an output unit for an information processor. On the other hand, in the ink jet head, menisci in the ink nozzles are pushed out in unstable forms by remaining vibration generated in the pressure build-up chambers. As a result, unnecessary ink droplets constructing no printing may be ejected immediately after necessary ink droplets are ejected. The ejection speed of the unnecessary ink droplets constructing no printing is so low that they adhere to nozzle surfaces and cause a phenomenon such as ink nozzle clogging or dot missing. Thus, the reliability on printing is lowered.

Further, when the printer is left for a long time in the state where the ink jet head is not driven, water, or the like, which is a solvent of ink, evaporates through the ink nozzles. As a result, the viscosity of ink in the ink nozzles increases so that the ink nozzles are clogged. Moreover, with the increase of the ink viscosity, the refil speed of the ink nozzles with ink becomes so low that the refill quantity cannot follow the ink ejection quantity. As a result, bubbles are mixed into ink so that the ink jet head is in a non-ejection state where no ink droplet is ejected. Thus, the reliability on printing is lowered in the same manner as mentioned above.

In the background art, for the former where a failure in ejection is caused by ink adhesion to nozzle surfaces, the nozzle surfaces are rubbed with a wiper (wiped) before the beginning of printing or during a rest period of printing, so that the nozzle surfaces are prevented from wetting due to the adhesion of unnecessary ink droplets to the nozzle surfaces. Further, the publication JP-A-4-369542 discloses a technique in which a second voltage different from a first voltage for ejecting ink droplets is applied to electrostrictive members so as to separate ejected ink droplets and reduce the ejection of unnecessary ink droplets.

On the other hand, for the latter where a failure in ejection is caused by ink nozzle clogging and bubbles in ink, the operation of ejecting several shots of ink droplets, that is, so-called pre-ejection is performed before the beginning of printing or during a rest period of printing. Further, the publication of JP-A-9-30007 proposes a method in which a pulse with electric power at the level at which no-ink droplet is ejected from ink nozzles is applied to electrostrictive members so as to micro-vibrate menisci in order to prevent the ink nozzles from being filmed with ink.

However, the above-mentioned background-art techniques have problems as follows.

1. In the wiping operation, there was a problem that printing time was elongated because the ink jet head had to be moved to shelter at a place other than a print area at any time when wiping was performed. In addition, there was a problem that water-repellant coatings on the nozzle surfaces were deteriorated by the repeated wiping of the nozzle surfaces.

2. In the case where a voltage was applied to the electrostrictive members in order to separate ink droplets, characteristic differences between the electrostrictive members might make it impossible to separate the ink droplet well and might eject even unnecessary ink droplets. Thus, there was a problem that it was difficult to attain stable ejection and separation of ink droplets.

3. In the pre-ejection operation, there was a problem that ink irrelevant to printing was markedly consumed so that the life of the ink tank was shortened. In addition, there was a problem that printing time was elongated because the ink jet head had to be moved to shelter at a place other than a print area at any time when pre-ejection was performed.

4. In regard to the driving method to apply such a low pulse voltage as to eject no ink droplets, if this method was applied to an ink jet head using electrostatic driving actuators, it was difficult to set a driving condition on which menisci were vibrated without ejecting any ink. Accordingly, there was a problem that ink droplets were ejected, or enough vibrations of the menisci to avoid a failure in ink ejection were not obtained. In addition, it was necessary to give driving signals to driving elements for all the ink nozzles respectively. Accordingly, there was a problem that driving control was complicated, etc.

OBJECTS OF THE INVENTION

It is an object of the present invention to provide an ink jet head that eliminates or reduces printing trouble caused by a failure or abnormality in ink ejection; an ink jet printer using such an ink jet head; and a method for driving such an ink jet head.

SUMMARY OF THE INVENTION (1) An ink jet head according to the present invention comprises a plurality of ink nozzles for ejecting ink, a plurality of ink chambers respectively communicating with a corresponding one of the ink nozzles, ink supply channels respectively supplying ink to a corresponding one of the ink chambers, elastically displaceable diaphragms respectively formed in a wall of a corresponding one of the ink chambers, and opposed electrodes oppositely arranged to the diaphragms through a gaps, to eject ink droplets from the ink nozzles by performing electric charge/discharge between the opposed electrodes and the diaphragms; wherein each of the opposed electrodes comprises a main electrode that can perform electric charge/discharge between it and a corresponding one of the diaphragms independently of the other main electrodes, and a sub-electrode that is electrically connected with the sub-electrodes for the other diaphragms.

In the present invention, the electrodes are driven in a desired combination (driving voltages are applied between the opposed electrodes and the corresponding diaphragm so as to perform electric charge/discharge therebetween), so that the quantity of ink ejected from an ink nozzle (density) can be adjusted in multiple stages. In addition, since each sub-electrode is electrically connected with the other sub-electrodes formed for the other diaphragms, a process for vibrating ink in the ink nozzles can be performed in common for the respective ink chambers. Thus, the control of such a process becomes easy.

(2) In the ink jet head according to the present invention as stated in paragraph (1), each main electrode is electrically charged and discharged selectively in accordance with a printing pattern, and a sub-electrode formed on the ink nozzle side is electrically connected with sub-electrodes formed for the other diaphragms. In the present invention, main electrodes are driven selectively in accordance with a printing pattern so that a process of printing is performed. In addition, sub-electrodes are driven appropriately so that ink in the ink nozzles can be vibrated or the effect of separating ejected ink droplets from the ink nozzles can be enhanced. That is, auxiliary electric charge is performed between a sub-electrode and diaphragm so that parts of the diaphragm are bent toward the sub-electrode. Thus, menisci or ink of the ink nozzles can be vibrated without ejecting unnecessary ink droplets. As a result, the menisci can be prevented from being filmed with ink, without ejecting ink droplets. In addition, ink in ink channels is diffused so that the viscosity of the ink can be prevented from increasing due to the evaporation of the solvent of the ink. Further, if sub-electrodes are driven before ink droplets are ejected, troubles in printing caused by a failure or abnormality in ink ejection can be prevented without consuming ink playing no part in printing, even after no ink droplets has been ejected for a certain time because of no operation of the ink nozzles.

(3) In the ink jet head according to the present invention as stated in paragraph (2), a first gap between the main electrodes and the diaphragms is made different from a second gap between the sub-electrodes and the diaphragms. According to the present invention, for example, auxiliary electric charge is performed between a sub-electrode and diaphragm so that a part of the diaphragm is bent toward the sub-electrode. As a result, the timing when a tail portion of a discharged ink column is separated from ink in the ink nozzle can be hastened so that the effect of separating an ink droplet from the ink nozzle can be further enhanced.

(4) In the ink jet head according to the present invention as stated in paragraph (3), the first gap is set to be larger than the second gap. In the present invention, for example, when a driving voltage equivalent to the driving voltage for a main operation (ink ejection) is applied for an auxiliary operation, a Coulomb force produced in the auxiliary operation is larger than Coulomb force produced in the main operation so that the bending speed of the diaphragm in the auxiliary operation becomes higher than that in the main operation. As a result, the operation that a meniscus in the ink nozzle is drawn into the ink chamber is hastened so that the tail portion of the ejected ink column can be separated more surely in the auxiliary operation. Thus, it is possible to form ink droplets stably.

(5) In the ink jet head according to the present invention as stated in paragraph (2), the main electrodes are provided correspondingly to the diaphragms, and each sub-electrode includes a first sub-electrode provided in common for the plurality of diaphragms so as to face the diaphragms on the ink nozzle side, and one or a plurality of second sub-electrodes provided in common for a plurality of the diaphragms so as to be disposed between the main electrodes and the first sub-electrode.

In the present invention, the sub-electrodes are divided in series so that the electrostatic capacity thereof is reduced. Thus, the time constant of the sub-electrodes are prevented from increasing, so that the difference between the time constant of a circuit associated with a main electrode and the time constant of a circuit associated with a sub-electrode is reduced. As a result, proper control timing can be obtained easily for controlling both the electrodes. In addition, the operation delay among auxiliary actuators formed by the sub-electrode is also reduced so that the proper operations of the main and sub-electrodes can be obtained.

For example, in the case where the main electrode and the sub-electrode are driven simultaneously so that control is made for increasing the quantity of ink to be ejected in comparison with the case where only the main electrode is driven (that is, control is made for adjusting the printing density in multiple stages), or in the case where the sub-electrode is driven at a predetermined time after the main electrode was driven so that control is made for cutting the tail portion (rear end) of the ejected ink column to avoid production of a surplus ink droplet, proper timings of the control can be obtained, since the difference between the time constants of the respective circuits associated with the main electrode and the sub-electrode is small. As a result, precise printing control can be performed. Incidentally, the concept of the time constants of the respective circuits in the present invention will be described in detail later in Embodiment 4. In addition, according to the present invention, the sub-electrode is constituted by a plurality of electrodes so that the ink ejection quantity (density) can be adjusted in more multiple stages. In addition, the sub-electrode is formed in common for a plurality of diaphragms so that increase of the number of wires connecting the electrodes, which is involved by increase of the number of ink nozzles, can be avoided. Thus, increase in size of the ink jet head can be avoided.

(6) In the ink jet head according to the present invention as stated in paragraph (2), each of the main electrodes and sub-electrodes includes an opposed portion formed of ITO and oppositely disposed to the diaphragm, and a lead portion electrically connected with the opposed portion, wherein at least the lead portion of the sub-electrode is formed of metal. In the present invention, at least the lead portion of the sub-electrode is composed of metal so that the time constant of the circuit associated with the sub-electrode is reduced. As a result, the difference between the time constant of the circuit associated with the sub-electrode and the time constant of the circuit associated with the main electrode is reduced.

(7) In the ink jet head according to the present invention as stated in paragraph (6), the metal is composed of gold formed on chromium or titanium. The metal is attached to the substrate stably, so that it withstands long-term use without fear of peeling off.

(8) In the ink jet head according to the present invention as stated in paragraph (2), the diaphragms are formed as a common electrode, and a time constant of a circuit constituted by each electrode of the opposed electrodes and the common electrode is much smaller than a natural vibration period of corresponding one of the ink channels. Accordingly, the difference between the time constants of the respective circuits is also reduced, so that proper control timing can be obtained easily. In addition, an operation delay caused between auxiliary actuators formed by the sub-electrodes is also reduced so that proper operations of the main electrodes and sub-electrodes can be assured.

(9) In the ink jet head according to the present invention as stated in paragraph (2), the main electrodes are provided correspondingly to the diaphragms while a sub-electrode is provided in common for a predetermined number of the diaphragms so as to face the diaphragms on the ink nozzle side, wherein a plurality of umits each having a predetermined number of main electrodes and a sub-electrode are disposed. Since the sub-electrode is divided in parallel so that the respective capacities of the divisional electrodes are reduced, the time constant of the circuit associated with the sub-electrode is prevented from increasing. As a result, the difference between the time constant of the circuit associated with the main electrode and the time constant of the circuit associated with the sub-electrode is reduced. In addition, a sub-electrode is formed in common for a plurality of diaphragms so that, even if the number of ink nozzles increases, the number of wires connected to the sub-electrodes can be prevented from increasing in accordance therewith. Thus, the above-mentioned operations can be attained without increasing the number of wires in the ink jet head or without increasing the number of wires connecting a control circuit with the ink jet head.

(10) In the ink jet head according to the present invention as stated in paragraph (9), every adjacent two of the units are disposed to be symmetrical with respect to a boundary line between the units. Since every two units are arranged in parallel and symmetrically in such a manner, no sub-electrode lies between the main electrode groups of the two units. Therefore, when the ink jet head is manufactured, pattern groups of the main electrodes with one and the same pitch may be produced. Thus, the ink jet head is manufactured easily.

(11) According to the present invention, there is provided an ink jet printer comprising an ink jet head which includes a plurality of ink nozzles for ejecting ink, a plurality of ink chambers communicating with the ink nozzles respectively, ink supply channels for supplying ink to the ink chambers respectively, elastically displaceable diaphragms formed in circumferential walls constituting the ink chambers respectively, and opposed electrodes oppositely arranged to the diaphragms through a gap respectively, to eject ink droplets from the ink nozzles by performing electric charge/discharge between the opposed electrodes and the diaphragms; wherein each of the opposed electrodes are constituted by a plurality of electrodes each of which can perform electric charge/discharge to corresponding one of the diaphragms independently of the other electrodes, and at least one of the plurality of electrodes is electrically connected with the electrodes formed for the other diaphragms. In the present invention, the plurality of electrodes in an opposed electrode are driven in a desired combination, so that the quantity of ink ejected from an ink nozzle (density) can be adjusted in multiple stages. In addition, since at least one of the plurality of electrodes is electrically connected with the other electrodes formed for the other diaphragms, for example, a process for vibrating ink in the ink nozzles can be performed in common for the respective ink chambers. Thus, the control of such a process becomes easy.

(12) In the ink jet printer according to the present invention as stated in paragraph (11), an opposed electrode includes a main electrode to be electrically charged and discharged selectively in accordance with a printing pattern, and a sub-electrode formed on the ink nozzle side and electrically connected with sub-electrodes formed for the other diaphragms. In the present invention, main electrodes are driven selectively in accordance with a printing pattern so that a process of printing is performed. In addition, sub-electrodes are driven appropriately so that ink in the ink nozzles can be vibrated or the effect of separating ejected ink droplets from the ink nozzles can be enhanced.

(13) The ink jet printer according to the present invention as stated in paragraph (12) comprises a main electrode driving circuit for electrically charging/discharging the main electrodes and the diaphragms so that ink droplets are discharged from the ink nozzles; and a sub-electrode driving circuit for electrically charging/discharging the sub-electrodes and the diaphragms in a predetermined period or at a desired time so that ink in the ink nozzles is vibrated. In the present invention, the main electrodes are driven by the main electrode driving circuit so as to eject ink droplets, and the sub-electrodes are driven by the sub-electrode driving circuit so as to vibrate ink in the ink nozzles.

(14) The ink jet printer according to the present invention as stated in paragraph (12) comprises: a main electrode driving circuit for electrically charging/discharging the main electrodes and the diaphragms so that ink droplets are ejected from the ink nozzles; and a sub-electrode driving circuit for electrically charging/discharging the sub-electrodes and the diaphragms at a desired time after electrically discharging the main electrodes, so that ink ejected from the ink nozzles are separated from ink remaining in the ink chambers. In the present invention, the main electrodes are driven by the main electrode driving circuit so as to eject ink droplets, and the sub-electrodes are driven by the sub-electrode driving circuit so as to separate ink ejected from the ink nozzles, from ink remaining in the ink chambers.

(15) According to the present invention, there is provided a method for driving an ink jet head which includes a plurality of ink nozzles for ejecting ink, a plurality of ink chambers communicating with the ink nozzles respectively, ink supply channels for supplying ink to the respective ink chambers, elastically displaceable diaphragms formed in circumferential walls constituting the ink chambers respectively, and opposed electrodes oppositely arranged to the diaphragms through a gap respectively, to eject droplets from the ink nozzles by performing electric charge/discharge between the opposed electrodes and the diaphragms; wherein each of the opposed electrodes is constituted by a plurality of electrodes each of which can perform electric charge/discharge to corresponding one of the diaphragms independently of the other electrodes, and at least one of the plurality of electrodes is electrically connected with the other electrodes formed for the other diaphragms, and wherein the method includes the step of performing electric charge/discharge between the respective electrodes of the opposed electrodes and the diaphragms appropriately so as to eject ink droplets from the ink chambers. In the present invention, a plurality of electrodes of an opposed electrode are driven in a desired combination, so that the quantity of ink ejected from an ink nozzle (density) can be adjusted in multiple stages. In addition, as an auxiliary operation, for example, ink in the ink nozzles can be vibrated, or the effect of separating ink droplets from the ink nozzles can be enhanced.

(16) In the ink jet head driving method according to the present invention as stated in paragraph (15), each of the opposed electrodes includes a main electrode to be electrically charged and discharged selectively in accordance with a printing pattern, and an sub-electrode formed on the ink nozzle side and electrically connected with other sub-electrodes formed for the other diaphragms. This method includes the step of performing electric charge/discharge between the main electrodes and the diaphragms so that ink droplets are ejected from the ink nozzles, and the step of performing electric charge/discharge between the sub-electrode and the diaphragms so that ink in the ink nozzles is vibrated.

In the present invention, the auxiliary electric charge is performed between the auxiliary electrodes and the diaphragms so that parts of the diaphragms are bent toward the sub-electrodes. Thus, menisci or ink of the ink nozzles can be vibrated without ejecting unnecessary ink droplets. As a result, the menisci can be prevented from being filmed with ink, without ejecting ink droplets. In addition, ink in the ink channels is diffused so that the increase in viscosity of the ink caused by the evaporation of the solvent of the ink can be avoided. In addition, if the sub-electrodes are driven prior to the ejection of ink droplets, a trouble in printing caused by a failure or abnormality in ink ejection can be prevented without consuming ink playing no part in printing, even after no ink droplets has been ejected for a certain time because of no operation of the ink nozzles.

(17) In the ink jet head driving method according to the present invention as stated in paragraph (15), each of the opposed electrodes includes a main electrode to be electrically charged and discharged selectively in accordance with a printing pattern and a sub-electrode formed on the ink nozzle side and electrically connected with other sub-electrodes formed for the other diaphragms. The method includes the step of performing electric charge/discharge between the main electrodes and the diaphragms so as to eject ink droplets from the ink nozzles, and the step of performing electric charge/discharge between the sub-electrodes and the diaphragms so that the ink droplets ejected from the ink nozzles are separated from ink remaining in the ink chambers.

In the present invention, auxiliary electric charge is performed between the sub-electrodes and the diaphragms so that parts of the diaphragms are bent toward the sub-electrodes. As a result, the time for tail portions of ejected ink columns to leave the ink nozzles is shortened so that the effect of separating ink droplets from the ink nozzles can be enhanced. In addition, the menisci in the ink nozzles are drawn into the ink chambers on ejecting ink droplets, so that unnecessary ink droplets can be prevented from being ejected immediately after ejecting ink droplets contributing to printing. Thus, if the sub-electrodes are driven at a predetermined interval after the time when the main electrodes have been driven to eject ink droplets, unnecessary ink droplets can be prevented from being ejected after ejecting the necessary ink droplets. Thus, troubles of printing caused by a failure or abnormality in ink ejection can be prevented, even if ink droplets have been continuously ejected from the nozzles for a long time without wiping the nozzle surfaces.

(18) In the ink jet head driving method according to the present invention as stated in paragraph (15), in the step of performing electric charge/discharge between the main electrodes and the diaphragms to eject ink droplets from the ink nozzles, ink droplets ejected previously are separated from ink remaining in the ink chambers when succeeding ink droplets are ejected immediately thereafter. For example, in the case where one dot is formed of a plurality of ink droplets, the operation described in the paragraph (17) can be obtained by ejecting a following ink droplet.

(19) In the ink jet head driving method according to the present invention as stated in paragraph (15), the main electrodes are provided correspondingly to the diaphragms, and the sub-electrodes include a first sub-electrode provided in common for a plurality of the diaphragms so as to face the diaphragms on the ink nozzle side, and one or a plurality of second sub-electrodes provided in common for a plurality of the diaphragms so as to be disposed between the main electrodes and the first sub-electrode, and wherein the main electrodes and the sub-electrodes are driven in a desired combination so that ink droplets are ejected from the ink nozzles. In the present invention, the main electrodes and the sub-electrodes are driven in a desired combination so that the ink discharge quantity (density) can be adjusted in multiple stages.

(20) In the ink jet head according to the present invention as stated in paragraph (6), the metal is formed of chromium, titanium, aluminum, or platinum.

(21) In the ink jet head according to the present invention as stated in paragraph (2), each of the main and sub-electrodes includes an opposed portion formed of ITO and oppositely disposed to said diaphragm, and a lead portion electrically connected with said opposed portion, and at least the lead portion of the sub-electrode comprises a metal thin film and an ITO thin film formed on the metal thin film.

(22) In the ink jet head according to the present invention as stated in paragraph (21), the metal thin film is formed of chromium, titanium, silver, or an alloy composed of silver, palladium and copper.

BRIEF DESCRIPTION OF THE DRAWINGS

FIG. 38 is a chart in which detailed manufacturing process and conditions are listed for main steps 1 to 4 of FIG. 37.

DESCRIPTION OF THE PREFERRED EMBODIMENTS

Embodiment 1

Figure 1:
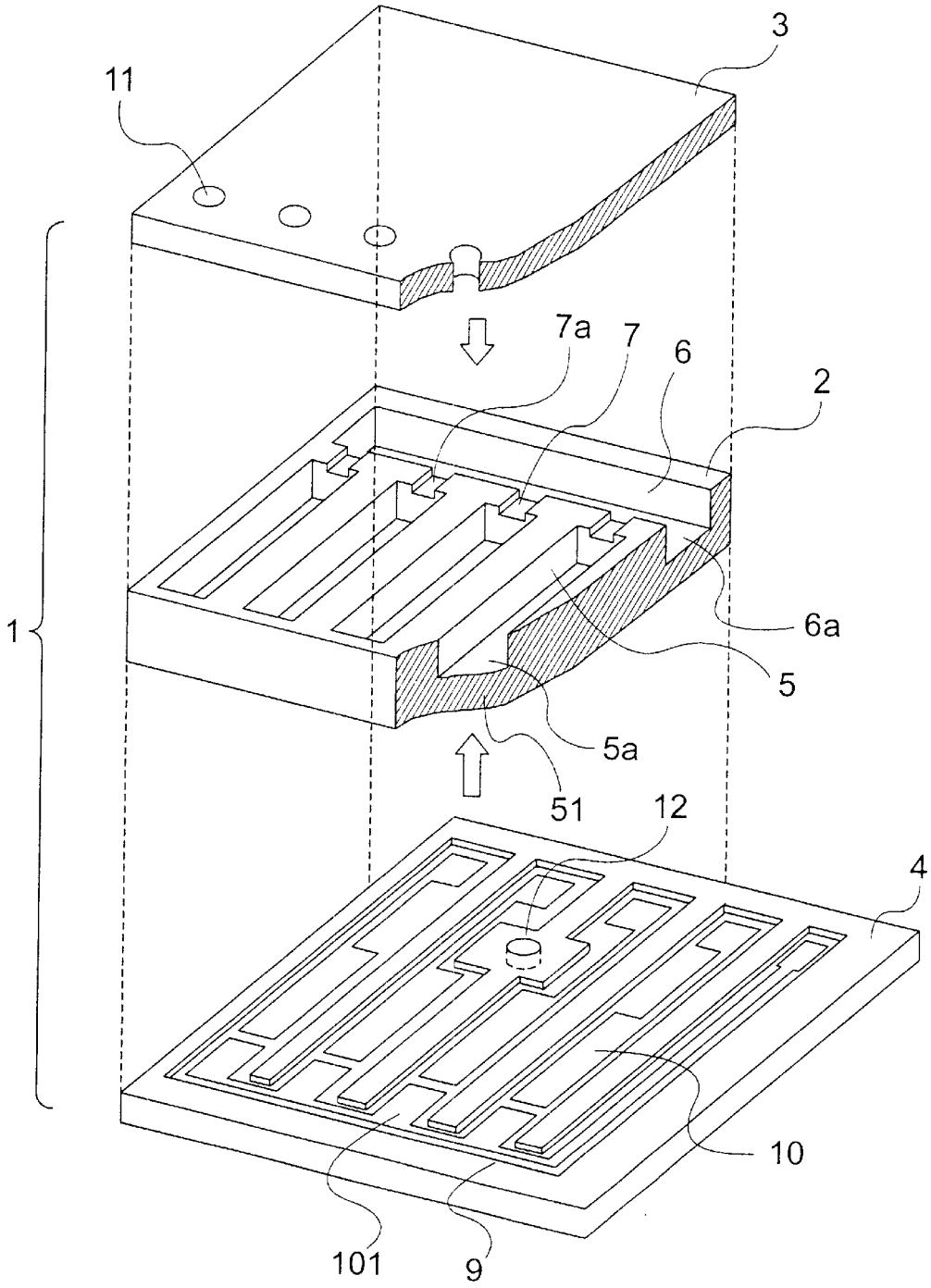
FIG. 1 is an exploded perspective view of an ink jet head according to a first embodiment of the present invention.
Figure 2:
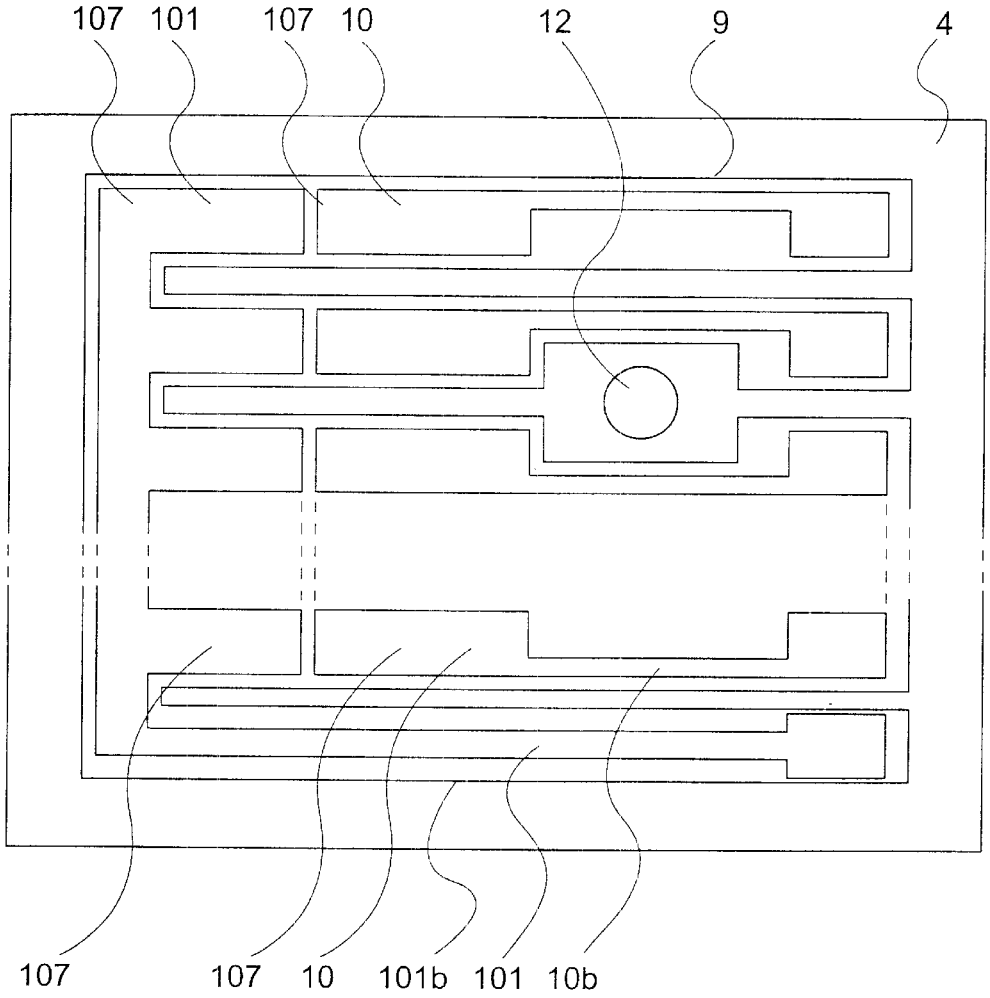
FIG. 2 is a plan view of a glass substrate of the ink jet head according to the first; embodiment.
Figure 3:
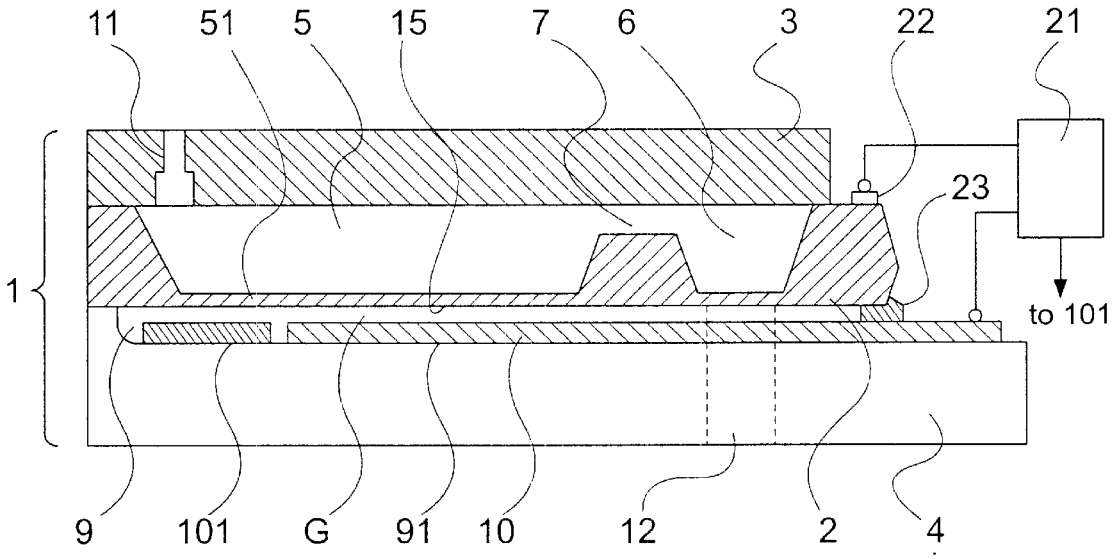
FIG. 3 is a partially sectional view of the ink jet head according to the first embodiment, which is an explanatory view showing an example of layout.

FIG. 1 is an exploded perspective view of an ink jet head according to a first embodiment of the present invention. FIG. 2 is a plan view of a glass substrate of the ink jet head. FIG. 3 is a partially sectional view of the ink jet head of FIG. 1.

As shown in these drawings, an ink jet head 1 has a laminated structure in which three substrates 2, 3 and 4 are put on top of one another and joined together and in which the middle silicon substrate 2 is sandwiched between the nozzle plate 3, similarly made of silicon, on the upper side thereof and the borosilicate glass substrate 4 having a thermal expansion coefficient close to that of silicon, on the lower side. Etching is applied to the silicon substrate 2 from the surface thereof so as to form recess portions 5*a* which will constitute independent ink chambers (pressure build-up chambers) 5, a recess portion 6*a* which will constitute a common ink chamber (reservoir) 6, and recess portions 7*a* which will constitute ink supply channels (orifices) 7 for supplying ink from the common ink chamber 6 to the respective ink chambers 5. These recess portions 5*a*, 6*a* and 7*a* are closed by the nozzle plate 3 so that the ink chambers 5, the common ink chamber 6 and the ink supply channels 7 are formed respectively.

In the nozzle plate 3, ink nozzles 11 are formed in positions corresponding to the front end portions of the respective ink chambers 5. These ink nozzles 11 communicate with the corresponding ink chambers 5 respectively. In addition, in the glass substrate 4, an ink supply port 12 is formed in a portion where the common ink chamber 6 is located so as to communicate with the common ink chamber 6. Ink is supplied from a not-shown external ink tank to the common ink chamber 6 through the ink supply port 12. The ink supplied to the common ink chamber 6 is in turn supplied to the independent ink chambers 5 through the corresponding ink supply channels 7 respectively.

Each of the ink chambers 5 has a bottom wall 51 formed to be thin. Each bottom wall 51 is formed to function as a diaphragm which can be elastically displaced in a direction perpendicular to the surface of the bottom wall 51, that is, in the up/down direction in FIG. 1. Therefore, in the description hereunder, each bottom wall 51 will be occasionally referred to as "a diaphragm" for convenience.

In the glass substrate 4 located under the silicon substrate 2, recess portions 9 etched to be shallow (for example, about 0.3 $\mu$m) are formed on the upper surface thereof which is a joint surface with the silicon substrate 2, in positions corresponding to the respective ink chambers 5 of the silicon substrate 2. Accordingly, the bottom walls 51 of the respective ink chambers 5 are opposed to recess portion surfaces 91 of the glass substrate 4 through a very narrow gap G. On the recess portion surfaces 91 of the glass substrate 4, opposed electrodes each of which is constituted by a main electrode 10 and a sub-electrode 101 are formed so as to be opposed to the bottom walls 51 of the respective ink chambers 5.

This sub-electrode 101 is formed on the side of the ink nozzles 11 so as to be able to perform charge/discharge independently of the portions of the diaphragms 51 opposed to the main electrodes 10. The sub-electrode 101 is formed as one electrode so as to be opposed in common to a plurality (for example, 64) of independent diaphragms 51. Since the sub-electrode 101 is formed as one electrode over the plurality of diaphragms 51, the number of electrodes does not accordingly increases to the increase of the number of nozzles, and it is not necessary to increase the area of the ink jet head 1 which is required for wiring for electrodes. As a result, it is possible to prevent the ink jet head 1 from increasing in size. In addition, since the sub-electrode 101 is electrically connected over a plurality of diaphragms 51, the ink chambers 5 can be controlled in common in the period of an auxiliary operation (for example, vibrating menisci) which will be described later. Thus, the ink chambers 5 can be easily controlled. In addition, the main electrodes 10 and the sub-electrode 101 are manufactured by sputtering ITO to form a thin film 107 of ITO, as shown in FIG. 2.

The silicon substrate 2 and the glass substrate 4 are joined to each other directly on side of the ink nozzles 11 while, on the opposite side, they are joined through thermosetting resin, for example, a bonding agent or the like. An end portion of the silicon substrate 2 is located on lead portions 10*b* and 101*b* of the main electrodes 10 and the sub-electrode 101. Since the silicon substrate 2 and the glass substrate 4 are joined through the aforementioned resin, the resin seals spaces formed between the back surface of the silicon substrate 2 and the recess portion surfaces 91 of the glass substrate 4 so that an air-tight sealing portion 23 is formed. In the case where resin is thus used for the air-tight sealing portion 23, since the viscosity of the resin which has not yet been hardened can be lowered easily, there is an advantage that the resin is made to penetrate narrow gaps by capillarity and then hardened at the time of sealing, to ensure air-tight sealing. Incidentally, an inorganic material such as glass having a low melting point may be used for the air-tight sealing portion 23.

Here, the bottom walls (diaphragms) 51 of the respective ink chambers 5 function as a common electrode on the ink chamber side because the silicon substrate 2 has electrically conductive. Therefore, the bottom walls will be occasionally referred to as "a common electrode". The surface of the bottom wall 51 of each of the ink chambers 5, which is opposed to the glass substrate 4, is covered with an insulating layer 15 consisting of a silicon oxide film. Thus, the bottom walls 51 of the respective ink chambers 5, that is, the diaphragms (common electrode) 51 are opposed to the respective main electrodes 10 and the sub-electrode 101 through the gap G and the insulating layers 15 formed on the surfaces of the bottom walls 51 of the ink chambers 5.

A voltage control circuit portion 21 for applying driving voltages between the main electrodes 10 and the diaphragms 51 and between the sub-electrode 101 and the diaphragms 51 applies driving voltages, as shown in FIG. 3, between a main electrode 10 and a diaphragm 51 and between a sub-electrode 101 and the diaphragm 51 in accordance with not-shown printing signal from the outside so as to cause electric charge/discharge therebetween. One output of the voltage control circuit portion 21 is connected to each of main electrodes 10 and the sub-electrode 101 while the other output is connected to a common electrode terminal 22 formed on the silicon substrate 2. In addition, if it is necessary to apply a driving voltage with a lower electric resistance to the diaphragms (common electrode) 51, for example, a thin film of conductive material such as gold may be formed on one surface of the silicon substrate 2 by vapor deposition or spattering. In this embodiment, the common electrode terminal 22 is constituted by a conductive film formed on the surface of the silicon substrate 2 where channels are formed.

Figure 4:
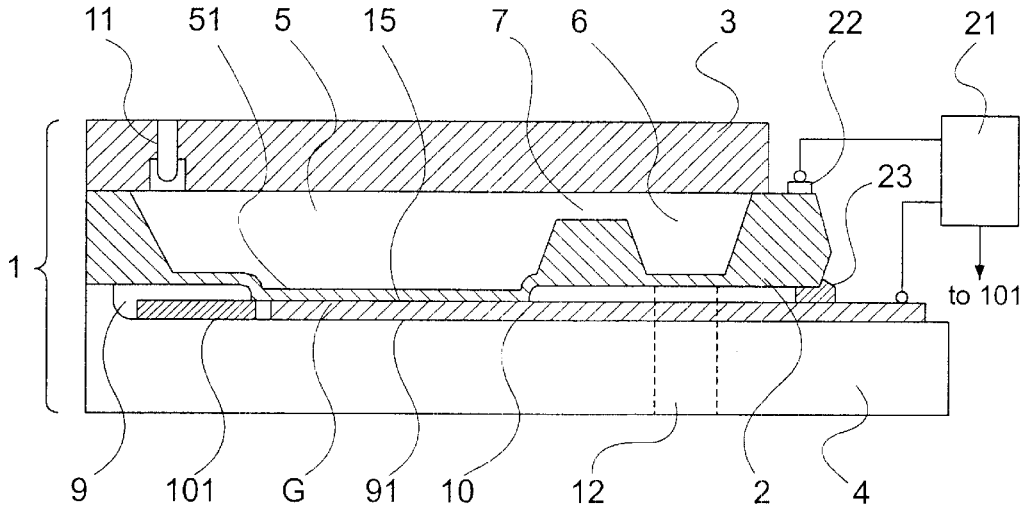
FIG. 4 is a partially sectional view of the ink jet head according to the first embodiment (Ink Ejection 1).

FIG. 4 is a partially sectional view of the ink jet head 1 according to this embodiment (see Ink Discharge 1 in FIG. 8 which will be described later). FIG. 4 shows the operation of a diaphragm 51 when a driving voltage is applied between a main electrode 10 and the diaphragm (common electrode) 51. In the ink jet head 1 configured as mentioned above, when a driving voltage from the voltage control circuit portion 21 is applied between the main electrode 10 and the diaphragm (common electrode) 51, Coulomb force is generated by an electric charge charged between the electrodes 10 and 51 so that the diaphragm 51 is bent toward the main electrode 10 and the ink chamber 5 expands in volume. Next, when the driving voltage from the voltage control circuit portion 21 is released so that the charge between the electrodes 10 and 51 is discharged, the diaphragm 51 is restored by the elastic restoring force thereof so that the ink chamber 5 shrinks in volume suddenly. By the ink pressure generated at this time, a part of ink filling up the ink chamber 5 is ejected in the form of an ink droplet from the ink nozzle 11 communicating with this ink chamber 5.

Figure 5:
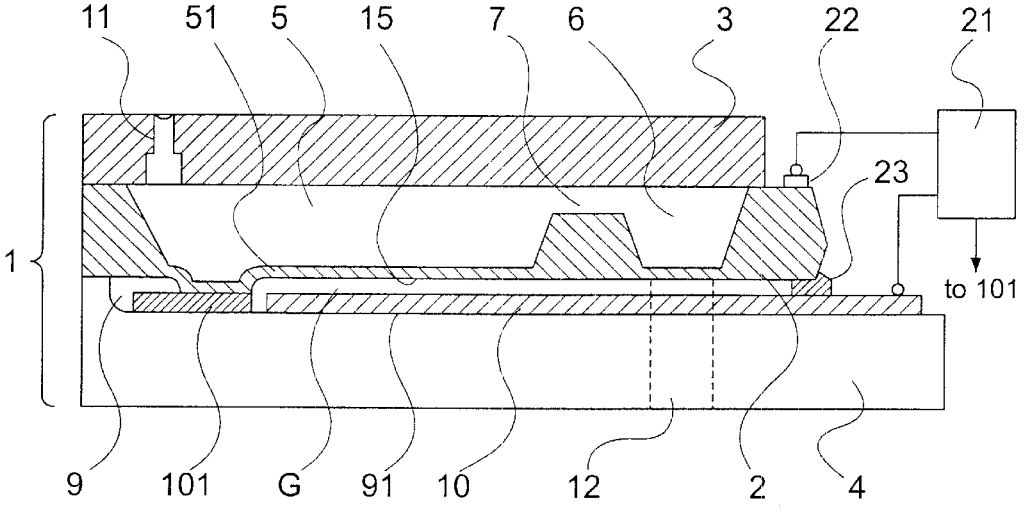
FIG. 5 is a partially sectional view of the ink jet head according to the first embodiment (Meniscus vibration).

FIG. 5 is a partially sectional view of the ink jet head 1 according to this embodiment (see Meniscus Vibration shown in FIG. 8 which will be described later). FIG. 5 shows the operation of the diaphragm 51 when a driving voltage is applied between a sub-electrode 101 and the diaphragm (common electrode) 51. When a driving voltage from the voltage control circuit portion 21 is applied between the sub-electrode 101 and the diaphragm (common electrode) 51, Coulomb force is generated by an electric charge charged between the electrodes 101 and 51 so that the diaphragm 51 is bent toward the sub-electrode 101 and the ink chamber 5 expands in volume. At the same time, a meniscus which is a border between the ink and the air in the ink nozzle 11 is drawn toward the ink chamber 5. Next, when the driving voltage from the voltage control circuit portion 21 is released so that the charge between the electrodes 101 and 51 are discharged, the diaphragm 51 is restored by the elastic restoring force thereof so that the ink chamber 5 shrinks in volume suddenly. Since the ink pressure generated at this time is smaller than the above-mentioned pressure generated by the electric charge/discharge of the main electrode 10 (because the area of the sub-electrode 101 is smaller than that of the main electrode 10), no ink droplet is discharged and the meniscus is vibrated, attenuated and restored. By repeating such electric charge/discharge between the sub-electrode 101 and the diaphragm 51, it is possible to vibrate the meniscus continuously so as to agitate the ink near the ink nozzle 11 and the ink filling up the ink chamber 5.

Figure 6:
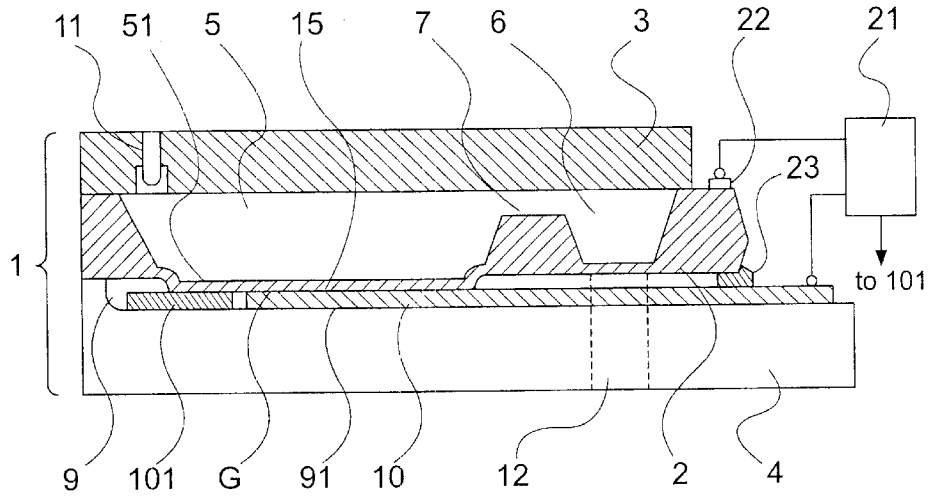
FIG. 6 is a partially sectional view of the ink jet head according to the first embodiment (Ink Ejection 2).

FIG. 6 is a partially sectional view of the ink jet head 1 according to this embodiment (see Ink Ejection 2 shown in FIG. 8 which will be described later). FIG. 6 shows the operation of the diaphragm 51 when a driving voltage is applied between an opposed electrode constituted by the sub-electrode 101 and main electrode 10, and the diaphragm 51. When a driving voltage from the voltage control circuit portion 21 is applied between the opposed electrode constituted by both electrodes 101 and 10, and the diaphragm 51 simultaneously, Coulomb force is generated by electric charges charged between the main electrode 10 and the diaphragm (common electrode) 51 and between the sub-electrode 101 and the diaphragm (common electrode) 51 so that the diaphragm 51 is bent toward the sub-electrode 101 and the main electrode 10, and the ink chamber 5 expands in volume. That is, the whole surface of the diaphragm 51 is bent so that the volume of the ink chamber 5 becomes in the most expanded state. Next, when the driving voltage from the voltage control circuit portion 21 is released so that the charges between the electrodes 10 and 51 and between the electrodes 101 and 51 are discharged, the whole surface of the diaphragm 51 is restored by the elastic restoring force of the diaphragm 51 so that the ink chamber 5 shrinks in volume suddenly. By the ink pressure generated at this time, a part of ink filling up the ink chamber 5 is ejected in the form of an ink droplet from the ink nozzle 11 communicating with this ink chamber 5. Since the greatest ink pressure can be generated at this time, it is possible to eject a larger quantity of ink droplet than that ejected by driving the diaphragm 51 only with the main electrode 10. That is, since an operation under the condition that the main electrode 10 and the sub-electrode 101 are integrated with each other is obtained here, a relatively large quantity of ink droplet is ejected as mentioned above.

Figure 7:
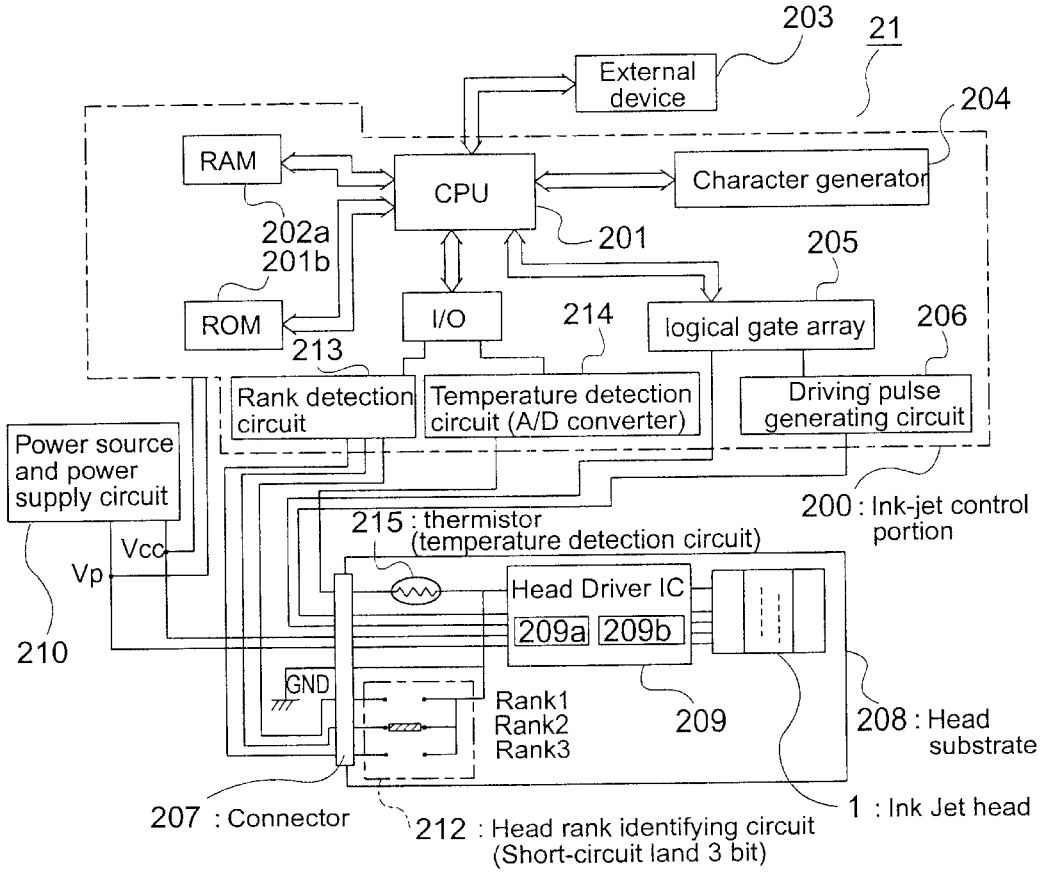
FIG. 7 is a block diagram showing the detail of a voltage control circuit portion in FIG. 3.

FIG. 7 is a block diagram showing the detail of the voltage control circuit portion 21 in FIG. 3. The voltage control circuit portion 21 of the ink jet head has an ink jet head control portion 200. This ink jet head control portion 200 is configured with a CPU 201 as a main part. That is, printing information is supplied to the CPU 201 from an external device 203 through a bus. The CPU 201 is connected to a ROM 202*a*, a RAM 202*b* and a character generator 204 through an internal bus, so as to use a storage area in the RAM 202*b* as a working area, execute a control program stored in the ROM 202*a*, and generate a control signal for driving the ink jet head 1 on the basis of character information generated from the character generator 204. The control signal is passed through a logical gate array 205 and a driving pulse generating circuit 206 so as to be converted into a driving control signal corresponding to the printing information. Then, the driving control signal is supplied, through a connector 207, to a head driver IC 209 formed on a head substrate 208. This head driver IC 209 is constituted by a main electrode driving control portion 209*a* for driving the main electrodes 10 and an sub-electrode driving control portion 209*b* for driving the sub-electrode 101.

On the basis of the driving control signal supplied thus, a driving voltage Vp supplied from a power supply circuit 210 and a signal transmitted from the logical gate array 205, the head driver IC 209 applies a driving pulse Pw, at predetermined timing, to the diaphragms (common electrode) 51 of the ink chambers 5 corresponding to the ink nozzles 11 to be driven, and the opposed electrodes formed on the recess portion surfaces 91, that is, the main electrodes 10 to be driven and the sub-electrode 101 in the ink jet head 1. That is, the head driver IC 209 appropriately selects the driving pulse Pw outputted from the driving pulse generating circuit 206 or the ground level so as to output either one of them with a low impedance to the electrodes 10, 101 and 51. As a result, for example, when the driving pulse Pw is applied to either the common electrode terminal 22 or the main electrodes 10, a potential difference is generated between the main electrodes 10 and the diaphragms (common electrode) 51 so that ink droplets are ejected from the associated ink nozzles 11. Similarly, when the driving pulse Pw is applied to either the common electrode terminal 22 or the sub-electrode 101, a potential difference is generated between the sub-electrode 101 and the diaphragms (common electrode) 51 so that, in the ink nozzles 11 associated with the sub-electrode 101, menisci are vibrated or drawn into the ink chambers 5.

Here, the driving pulse Pw applied to the main electrodes 10 may have the same width as the driving pulse Pw applied to the sub-electrode 101, or may have a driving waveform with a different voltage and a different conducting period. In the case where the driving pulse applied to the main electrodes 10 is different from the driving pulse applied to the sub-electrode 101, the different waveforms are formed respectively in the driving pulse generating circuit 206, and the head driver IC 209 decides which of the waveforms is to be applied to which of the electrodes 10 and 101, on the basis of a signal outputted from the logical gate array 205.

In addition, this voltage control circuit portion 21 can watch, for example, whether there is an ink nozzle 11 which has been unused for a long time. If such an ink nozzle 11 is present, the voltage control circuit portion 21 drives the sub-electrode 101 of the ink jet head 1 so as to vibrate the menisci. As a result of this process, ink ejection can be performed normally.

Thus, in the voltage control circuit portion 21 of the ink jet head 1 according to this embodiment, the driving pulse Pw is selectively applied to the main electrodes 10 and the sub-electrode 101 of the ink jet head 1 on the basis of the driving state of the ink jet head 1. As a result, even if the ink nozzles 11 have been unused for a long time, a change of the ink discharge characteristic due to the change of the physical properties of ink in the ink nozzles 11 is compensated surely so that a stable ink ejection characteristic can be always obtained.

Incidentally, in the voltage control circuit portion 21 in FIG. 7, the output of a thermistor (temperature detection circuit) 25 provided on the head substrate 208 is supplied to a temperature detection circuit (A/D converter) 214 through the connector 207, and used for temperature compensation of the ink jet head 1. On the other hand, the output of a head rank identifying circuit (short-circuit land, 3 bits) 212 provided likewise on the head substrate 208 is supplied to a rank detection circuit 213 through the connector 207 so that a head rank is detected and control is performed in accordance with the head rank.

Next, description will be made about a method for driving the ink jet head 1 according to this embodiment. FIG. 8 is a timing chart showing an example of a driving pulse applied to the ink jet head 1. Here, the potentials applied between the main electrode 10 and the diaphragm 51 and between the sub-electrode 101 and the diaphragm 51 are designed to be reversed alternately. This is intended to stabilize the characteristic of the ink jet head driven electrostatically. The present invention is however not limited to such a combination of the driving waveforms in which the potentials are reversed alternately as described in this embodiment. A similar operation can be obtained even if the potentials are not reversed alternately.

Figure 8:
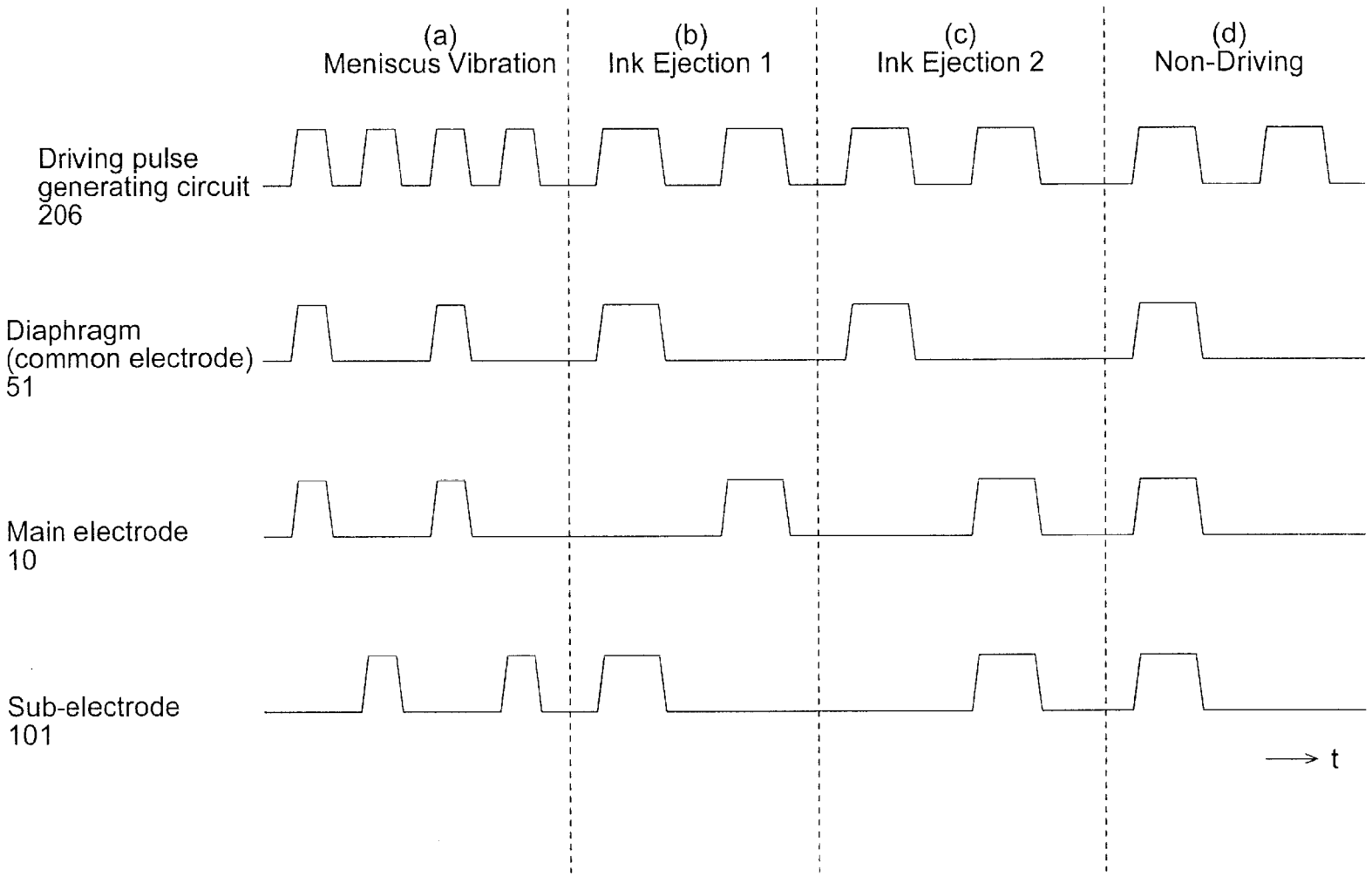
FIG. 8 is a timing chart showing an example of a driving pulse applied to the ink jet head according to the first embodiment.

In the timing chart of FIG. 8, the method for driving the ink jet head 1 is roughly classified into four driving patterns. In the meniscus driving pattern of FIG. 8(*a*), the meniscus of the ink nozzle 11 is vibrated by electric charge/discharge between the sub-electrode 101 and the diaphragm 51 (see FIG. 5). According to the waveform of FIG. 8(*a*), the meniscus is vibrated four times. In the driving pattern of Ink Ejection 1 of FIG. 8(*b*), an ink droplet is ejected by electric charge/discharge between the main electrode 10 and the diaphragm 51 (see FIG. 4). According to the waveform of FIG. 8(*b*), ink ejection is performed twice. In the driving pattern of Ink Ejection 2 of FIG. 8(*c*), an ink droplet is ejected by electric charge/discharge between the main electrode 10 and the diaphragm 51 and between the sub-electrode 101 and the diaphragm 51 (see FIG. 6). Since the diaphragm 51 is driven so as to bend the whole surface thereof, the ink ejection quantity becomes larger than that in Ink Ejection 1, so that darker printing can be performed. According to the waveform of FIG. 8(*c*), ink ejection is performed twice. On the other hand, in the non-driving pattern of FIG. 8(*d*), conducting is performed on the electrodes 10 and 101 and the diaphragm 51 so that they always have the same potential (see the state of FIG. 3). At this time, no ink droplet is ejected and no meniscus is vibrated.

As has been described above, in this embodiment, vibration given to the meniscus prevents an ink nozzle from clogging even if it has been unused for a long time, so that ejection of an ink droplet can be normally performed. Further, since multistage adjustment or incremental adjustment in the ink ejection quantity can be realized, as shown in Ink Ejection 1 and 2, the printing density can be adjusted accordingly.

Embodiment 2

Figure 9:
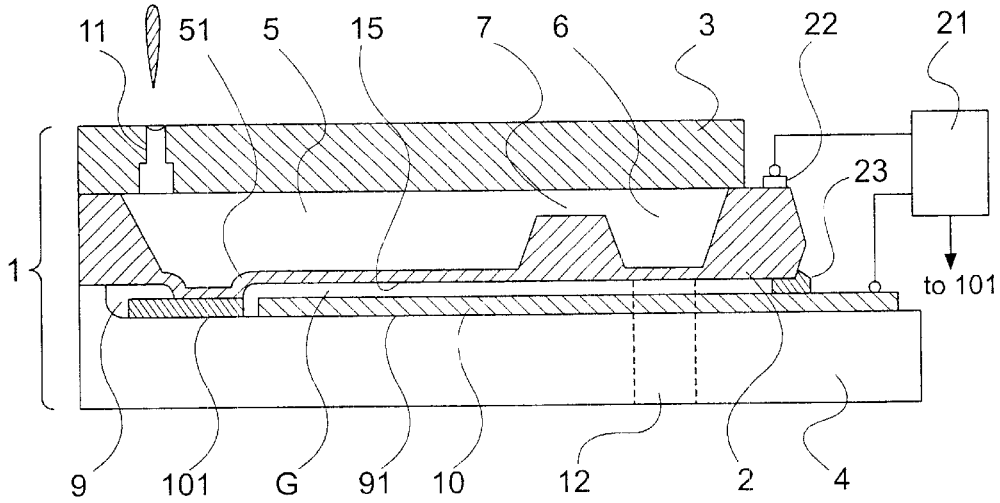
FIG. 9 is a partially sectional view of an ink jet head according to a second embodiment of the present invention.

FIG. 9 is a partially sectional view of an ink jet head 1 according to a second embodiment of the present invention (with the same configuration as that in the above-mentioned first embodiment). FIG. 9 shows the operation of the diaphragm (common electrode) 51 when applying a driving voltage between the sub-electrode 101 and the diaphragm 51. In this embodiment, a tail portion (rear end) of an ink column after ejection of an ink droplet is cut aggressively so that a surplus ink droplet (satellite) is prevented from being produced.

A driving voltage from the voltage control circuit portion 21 is applied between the sub-electrode 101 and the diaphragm (common electrode) 51 after a driving voltage from the voltage control circuit portion 21 is applied between the main electrode 10 and the diaphragm 51 so as to eject an ink droplet (see FIG. 4). Coulomb force is generated by an electric charge charged between the electrodes 101 and 51, and the diaphragm 51 is bent toward the sub-electrode 101 so that the ink chamber 5 expands in volume in the same manner as described above. At the same time, a meniscus which is a border between the ink and the air in the ink nozzle 11 is drawn toward the ink chamber 5 side of the nozzle 11. Next, when the driving voltage from the voltage control circuit portion 21 is released so that the charge between the electrodes 101 and 51 is ejected, the diaphragm 51 is restored by the elastic restoring force thereof so that the ink chamber 5 shrinks in volume suddenly. Since the ink pressure generated at this time is smaller than the above-mentioned pressure generated by the electric charge/discharge of the main electrode 10, no ink droplet is ejected and the meniscus is vibrated, attenuated and restored after it is drawn into the ink chamber 5.

In such a manner, in this embodiment, a main operation in which ink droplets are ejected by electric charge/discharge between the main electrodes 10 and the diaphragms 51 is followed by an auxiliary operation in which electric charge/discharge is performed between the sub-electrode 101 and the diaphragms 51 so that menisci are drawn into the ink chambers 5 as mentioned above. By these main and auxiliary operations, the tail portions (rear ends) of the ink columns ejected from the ink nozzles 11 by the main operation are separated surely by the above-mentioned auxiliary operation, so that ink droplets can be formed stably. As a result, it is possible to prevent unnecessary ink droplets from being formed, or to prevent ink droplets from spattering. Further, by these operations, it is possible to prevent a failure in ink ejection due to unnecessary ink droplets adhering to the nozzle surfaces, and hence to prevent a stain on a printer or a failure in printing.

The main operation for ink ejection and the following auxiliary operation for separating ink droplets are performed at a predetermined interval of time. This time interval between the main operation and the auxiliary operation is preset as a phase difference between the driving pulses for driving the corresponding electrodes respectively. It is preferable that this phase difference is set to be substantially equal to the time which is the width Pws of the driving pulse applied to the main electrode 10 plus a natural period $T_0$ of a vibration system for ink in the ink channel, which system is constituted by the ink nozzle 11 and the ink chamber 5 (diaphragm 51). That is, it is preferable that the electrodes are driven and operated with the phase difference between the driving pulses which is preset to be a time interval of $T_0$+Pws. Ink ejection is performed after the time of half the natural period has passed since the driving pulse for performing the main operation was released. Further after half the natural period, the distance between the sub-electrode 101 and the diaphragm 51 is made the smallest by free vibration in the ink channel at the time of ink ejection, so that the sub-electrode 101 can be electrostatically sucked and operated efficiently.

Further, when the time corresponding to the natural vibration period $T_0$ has passed after releasing the driving pulse for the main operation, the menisci jump out of the ink nozzles 11 most. It is therefore the most important to draw the menisci into the ink chambers 5 at this phase difference. Even if respective heads differ in strict natural period from one another because of the difference in dimension among the ink nozzles 11 or in thickness among the diaphragms, the phase difference between these driving pulses is made to coincide with approximate $T_0$+Pws in advance so that the menisci can be drawn into the corresponding ink chambers 5 at the time of strict $T_0$+Pws automatically in the auxiliary operation. As a result, the tail portions (rear ends) of the ink columns ejected from the ink nozzles 11 are separated surely, so that ink droplets can be formed stably.

Incidentally, as shown in FIG. 6, even in the case where a driving voltage is simultaneously applied both to the main electrode 10 and the sub-electrode 101 so as to operate both the electrodes as one electrode for ejecting an ink droplet, the above-mentioned auxiliary operation following the main operation makes it possible to separate a tail portion (rear end) of an ink column ejected from the ink nozzle 11 as mentioned above, so that an ink droplet can be formed stably. In that case, it is possible to form an ink droplet having a quantity different from the ejection quantity by the operation previously described in FIG. 4. Thus, the ink ejection quantity can be changed by the driving pattern. As a result, the size of each formed dot can be controlled by changing the driving pattern to change the density of the printing result, or printing with rich expression can be attained.

Figure 10:
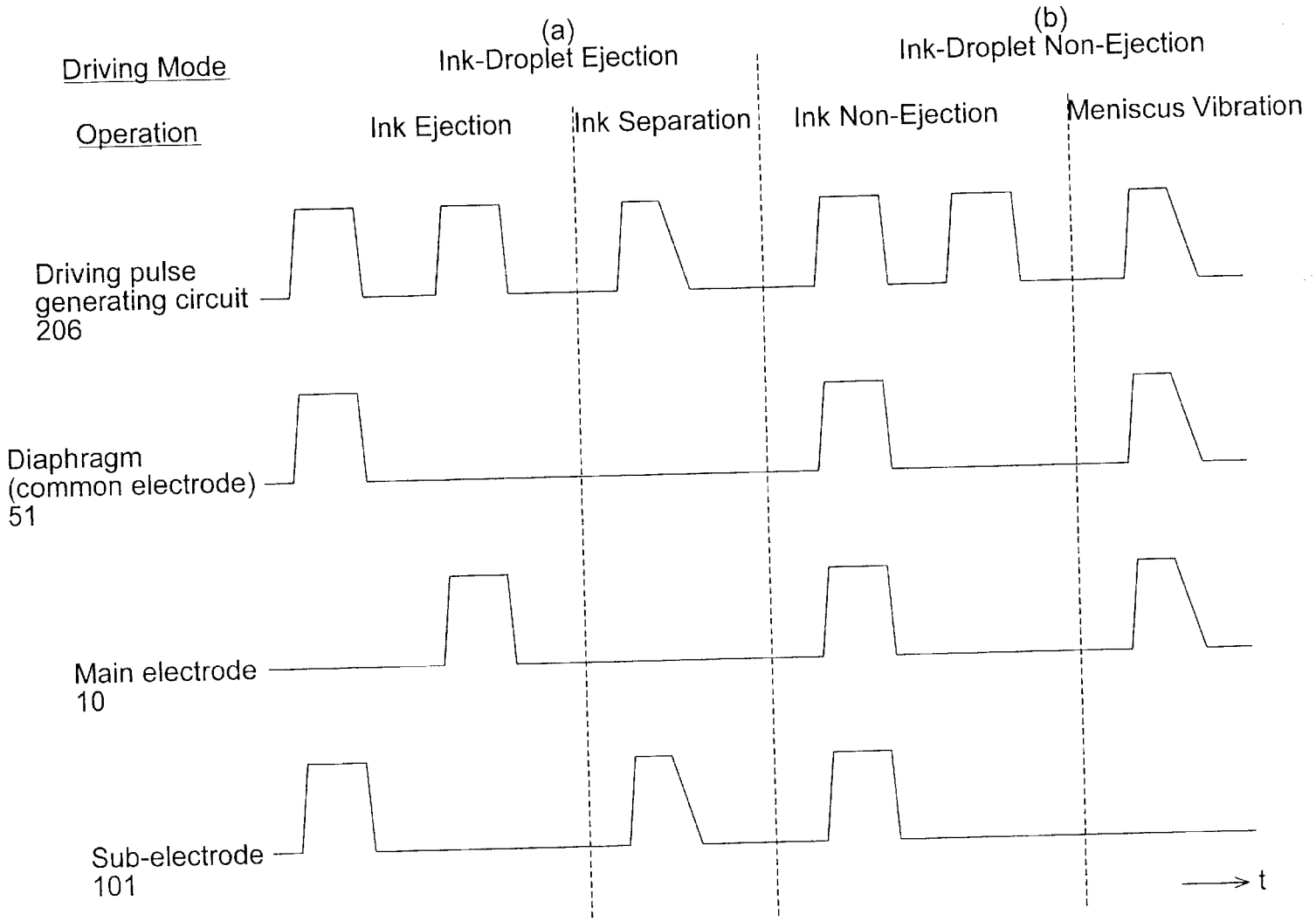
FIG. 10 is a timing chart showing an example of driving modes of the ink jet head according to the second embodiment.

Next, description will be made about a method for driving the ink jet head 1 according to this embodiment. FIG. 10 is a timing chart showing an example of a driving mode of the ink jet head 1 according to this embodiment. Assume that a driving pulse in FIG. 10 is generated by the above-mentioned voltage control circuit portion 21 in FIG. 7.

Here, the driving pulse is generated in the same manner as that in the above-mentioned embodiment, but the discharge time of the driving waveform for driving the sub-electrode 101 is set to be longer (so as to make the fall time of the pulse longer) so that the driving waveform differs from the driving waveform for driving the main electrodes 10. Thus, the vibration of the menisci after drawing-in the menisci is attenuated quickly so that the menisci are restored to their stand-by positions so as to be ready for the next driving of the main electrodes 10. Thus, the ink jet head 1 can be driven at a high driving frequency so that the speed of printing can be increased.

In the timing chart of FIG. 10, two kinds of driving modes, that is, Ink-Droplet Ejection and Ink-Droplet Non-Ejection, are shown by way of example. In the driving mode of Ink-Droplet Ejection in FIG. 10(*a*), the ink ejection operation is performed twice by electric charge/discharge between both electrodes 10 and 101, and the diaphragm (common electrode) 51, and succeedingly the operation for separating the ink ejected in the second ink ejection is performed. Ink droplets are thereby formed and ejected so that one picture element is printed on the printing surface (see FIGS. 6 and 9). Incidentally, in this example, it is assumed that every picture element is produced by two ink droplets, and the timing of the second ink ejection (the time from the first ink-droplet ejection operation to the second ink-droplet ejection operation) coincides with the timing of the above-mentioned separation operation by the sub-electrode 101 (the time from the second ink-droplet ejection operation to the separation operation). Thus, a tail portion (rear end) of an ink column ejected in the first ink ejection operation is cut by the second ink ejection operation so that the ink droplet is separated in the same manner as in the aforementioned case with the sub-electrode 101. This fact similarly applies to embodiments which will be described later.

On the other hand, in the driving mode of Ink-Droplet Non-Ejection in FIG. 10(*b*), no ink droplet is ejected while only the meniscus vibration is performed by electric charge/discharge between the sub-electrode 101 and the diaphragm (common electrode) 51 (see FIGS. 5 and 9). At this time, no picture element is printed on the printing surface. However, since the potential of the sub-electrode 101 is reversed, accumulation of the charges between the sub-electrode 101 and the diaphragms (common electrode) 51 is prevented. In addition, the ink in the ink nozzles 11 having a viscosity increased by ejecting no ink droplets is diffused into the ink chambers 5 by the vibration of the menisci, so that any failure of following ink ejection caused by preceding ejection of no ink droplets can be prevented. Since the driving mode of Ink-Droplet Non-Ejection is formed of such a driving pattern, it is possible to refresh charges between the sub-electrode 101 and the diaphragm (common electrode) 51 and refresh ink in the ink nozzle 11. By employing the driving modes shown in FIG. 10, the ink jet head 1 can be controlled with a simple circuit configuration.

In such a manner, in this embodiment, the sub-electrode 101 (or the main electrodes 10) is driven at a predetermined time after driving the main electrodes 10 to eject ink droplets as in the above-mentioned driving mode of Ink-Droplet Ejection, so that the rear ends of the ink columns ejected previously are cut. As a result, ink droplets with stable shapes can be obtained, and production of surplus ink (satellites) is prevented.

Embodiment 3

Figure 11:
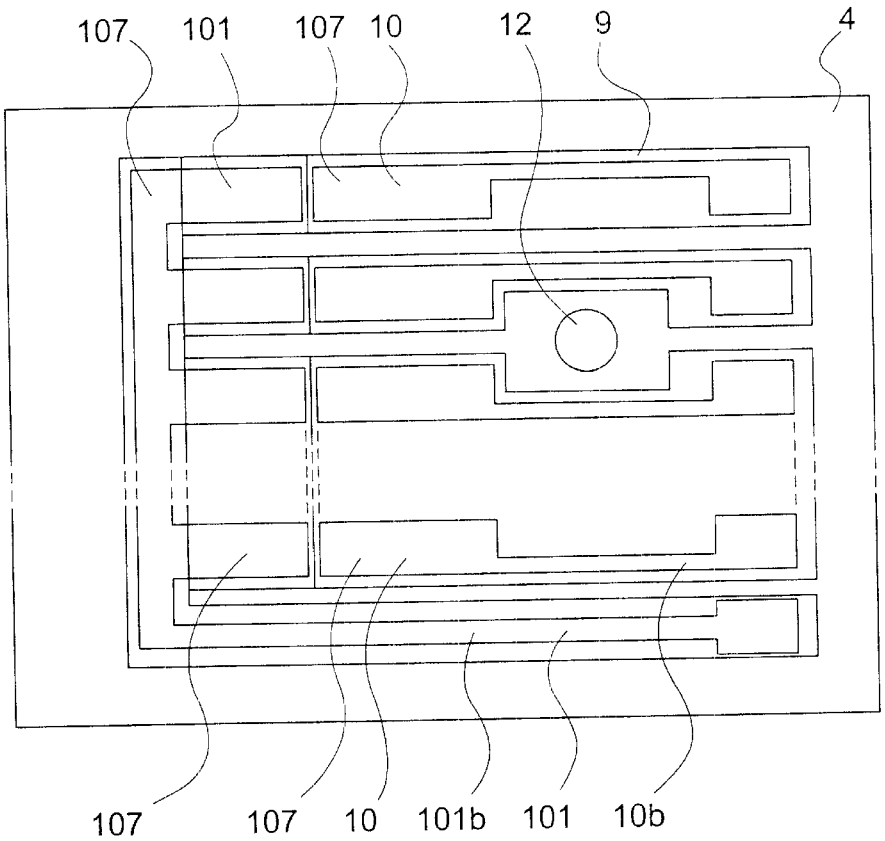
FIG. 11 is a plan view of a glass substrate of an ink jet head according to a third embodiment of the present invention.
Figure 12:
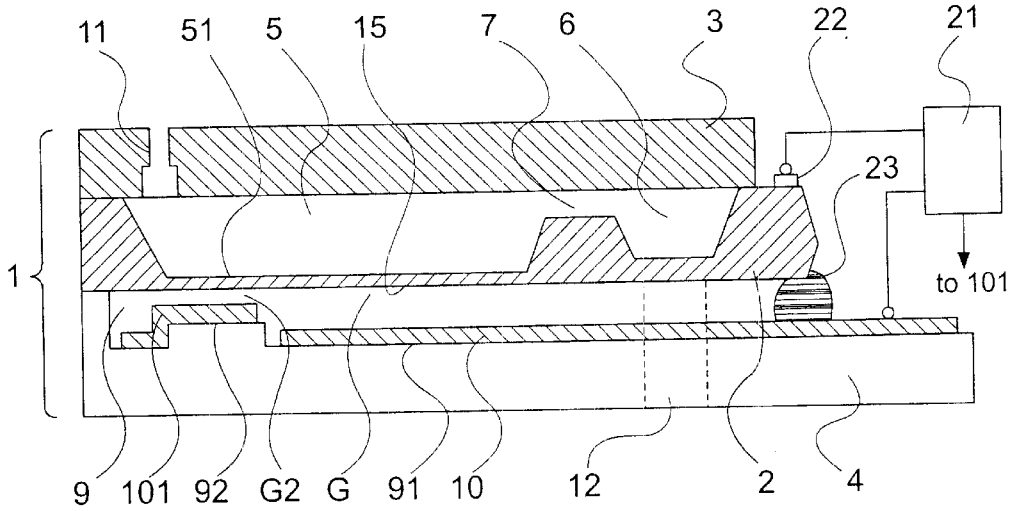
FIG. 12 is a partially sectional view of the ink jet head according to the third embodiment.

FIG. 11 is a plan view of a glass substrate in an ink jet head according to a third embodiment of the present invention. FIG. 12 is a partially sectional view of the same ink jet head.

Although the ink jet head 1 in this embodiment has the same basic configuration as that of the above-mentioned ink jet head of FIGS. 1 to 3, it is so configured that a gap G between the main electrode 10 and the diaphragm 51 differs from a gap G2 between the sub-electrode 101 and the diaphragm 51. To obtain such a configuration, the recess portions 9 of the glass substrate 4 are etched to be shallow with different depths, and a place 92 where the sub-electrode 101 is to be disposed is etched to be particularly shallow.

Figure 13:
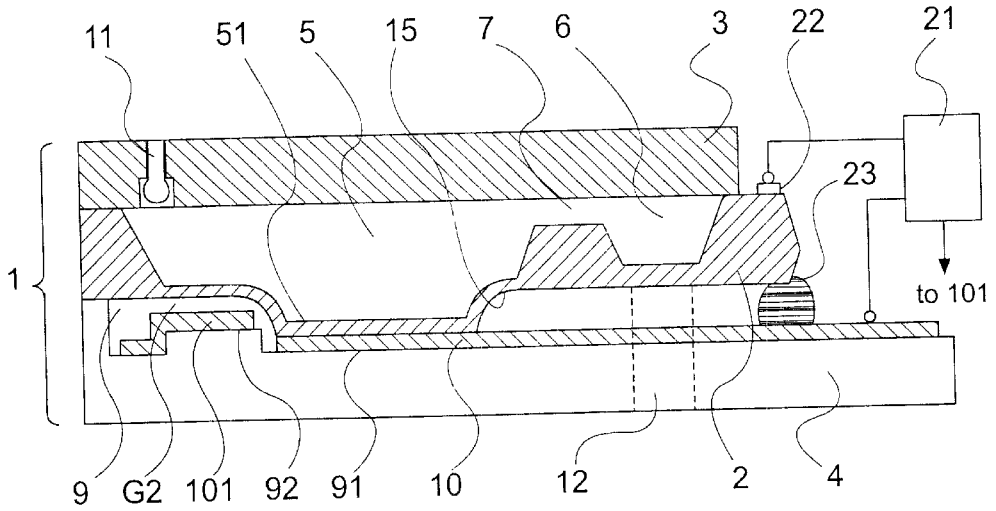
FIG. 13 is a partially sectional view of the ink jet head according to the third embodiment (Ink Ejection 1).

FIG. 13 is a partially sectional view of the ink jet head 1 (see Ink Discharge 1 in FIG. 16 which will be described later). FIG. 13 shows the operation of the diaphragm 51 when applying a driving voltage between the main electrode 10 and the diaphragm 51. In the ink jet head 1 configured thus, when a driving voltage from the voltage control circuit portion 21 is applied between the main electrode 10 and the diaphragm (common electrode) 51, Coulomb force is generated by an electric charge charged between the electrodes 10 and 51 so that the diaphragm 51 is bent toward the main electrode 10 and the ink chamber 5 expands in volume, in the same manner as in the above-mentioned first embodiment. Next, when the driving voltage from the voltage control circuit portion 21 is released so that the charge between the electrodes 10 and 51 are discharged, the diaphragm 51 is restored by the elastic restoring force thereof so that the ink chamber 5 shrinks in volume suddenly. By the ink pressure generated at this time, a part of ink filling up the ink chamber 5 is ejected as an ink column from the ink nozzle 11 communicating with this ink chamber 5. After the ejection, the ink forms an ink droplet by its own surface tension and lands on the printing surface.

Figure 14:
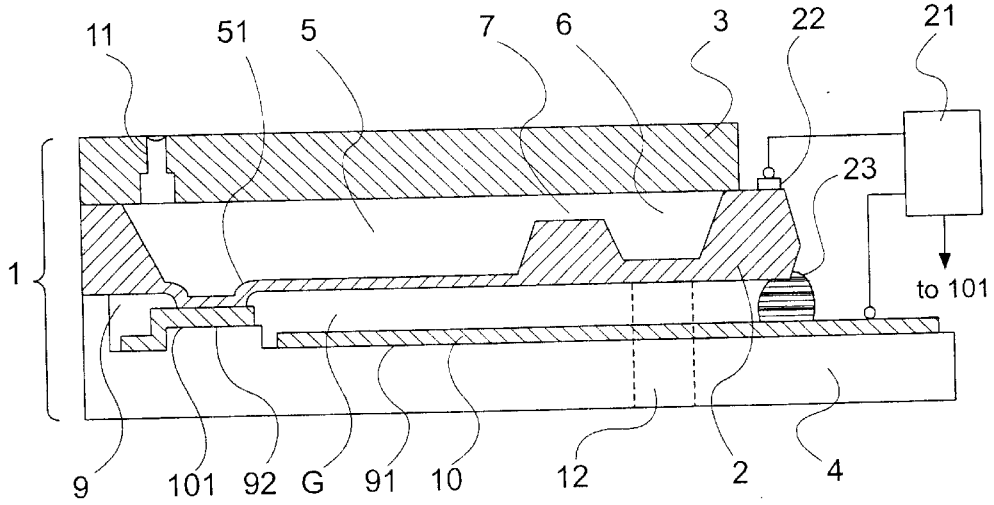
FIG. 14 is a partially sectional view of the ink jet head according to the third embodiment (Meniscus vibration).

FIG. 14 is a partially sectional view of the ink jet head 1 (see Meniscus Vibration in FIG. 16 which will be described later). FIG. 14 shows the operation of the meniscus and the diaphragm 51 when applying a driving voltage between the sub-electrode 101 and the diaphragm 51. When a driving voltage from the voltage control circuit portion 21 is applied between the sub-electrode 101 and the diaphragm (common electrode) 51, Coulomb force is generated by an electric charge charged between the electrodes 101 and 51 so that the diaphragm 51 is bent toward the sub-electrode 101 and the ink chamber 5 expands in volume. At the same time, the meniscus which is a border between the ink and the air in the ink nozzle 11 is drawn into the ink chamber 5 side of the nozzle 11. Next, when the driving voltage from the voltage control circuit portion 21 is released so that the charge between the electrodes 101 and 51 are discharged, the diaphragm 51 is restored by the elastic restoring force thereof so that the ink chamber 5 shrinks in volume suddenly. Since the ink pressure generated at this time is smaller than the above-mentioned pressure generated by the electric charge/discharge of the main electrode 10, no ink droplet is ejected and the meniscus is vibrated, attenuated and restored after it is drawn into the ink chamber 5.

When electric charge/discharge between the sub-electrode 101 and the diaphragm 51 follows the main operation in which ink is ejected by electric charge/discharge between the main electrode 10 and the diaphragm 51, an auxiliary operation for drawing the meniscus into the ink chamber 5 is performed. By these main and auxiliary operations, a tail portion (rear end) of an ink column ejected from the ink nozzle 11 by the main operation is separated surely by the auxiliary operation so that an ink droplet can be formed stably, in the same manner as in the above-mentioned second embodiment. As a result, it is possible to prevent unnecessary ink droplets from being formed, or to prevent ink droplets from spattering.

Further, because of the gap G2 set to be narrower than the gap G, when a driving voltage equivalent to a driving voltage for the main operation is applied for the auxiliary operation, Coulomb force generated in the auxiliary operation is larger than that generated in the main operation so that the diaphragm 51 is bent at a higher speed in the auxiliary operation than in the main operation. As a result, it is possible to accelerate the operation in which the meniscus in the ink nozzle 11 is drawn into the ink chamber 5. Thus, the ejected ink column can be separated more surely in the auxiliary operation so that an ink droplet can be formed stably. In addition, if it is desired that the speed of bending the diaphragm 51 in the auxiliary operation is substantially as high as the speed of bending the diaphragm 51 in the main operation, the driving voltage applied to the sub-electrode 101 may be reduced (in the examples of FIGS. 16 and 17, the voltage of the driving pulse is reduced). Thus, the power consumption can be reduced. By these operations, it is possible to prevent a failure in ink ejection caused by the unnecessary ink droplets adhering to the nozzle surfaces and hence to prevent a stain on a printer or a failure in printing.

Incidentally, the main operation for ejecting ink and the succeeding auxiliary operation for separating an ink droplet is performed at a predetermined interval of time. Since the interval of time is just as described above, description about it will be omitted. This fact similarly applies to embodiments which will be described later.

Figure 15:
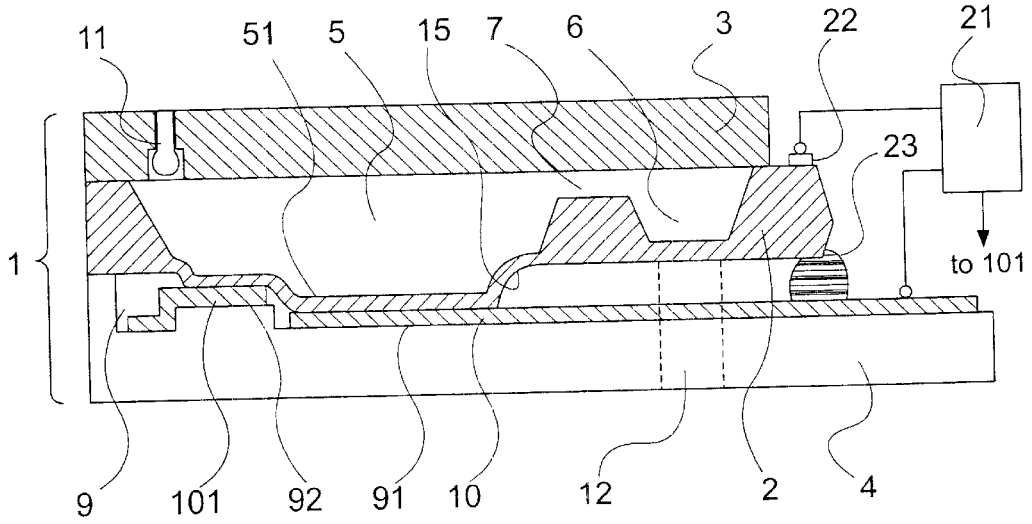
FIG. 15 is a partially sectional view of the ink jet head according to the third embodiment (Ink Ejection 2).

FIG. 15 is a partially sectional view of the ink jet head 1 according to this embodiment (see Ink Ejection 2 in FIG. 16 which will be described later). FIG. 15 shows the operation of the meniscus and the diaphragm 51 when applying a driving voltage between an opposed electrode constituted by both electrodes 101 and 10, and the diaphragm 51. When a driving voltage from the voltage control circuit portion 21 is applied between the opposed electrode constituted by the electrodes 101 and 10, and the diaphragm (common electrode) 51, Coulomb force is generated by electric charges charged between the electrode 10 and the diaphragm 51 and between the sub-electrode 101 and the diaphragm 51 so that the diaphragm 51 on the sub-electrode 101 side receiving large Coulomb force is first bent as shown in FIG. 14 and then the diaphragm 51 on the main electrode 10 side is bent as shown in FIG. 15. Thus, the ink chamber 5 expands in volume. Since the diaphragm 51 on the sub-electrode 101 side is bent in advance before the diaphragm 51 on the main electrode 10 side is bent, the timing when the diaphragm 51 on the main electrode 10 side starts bending is brought forward in comparison with that in the above-mentioned case where only the main electrode 10 is driven as shown in FIG. 13. That is, the ink chamber 5 expands most in volume, since the bending speed of the diaphragm 51 is accelerated and the diaphragm 51 is bent as a whole.

Next, when the driving voltage from the voltage control circuit portion 21 is released so that the electric charges between the electrodes 10 and 51 and between the electrodes 101 and 51 are discharged, the diaphragm 51 as a whole is restored by the elastic restoring force thereof so that the ink chamber 5 shrinks in volume suddenly. By the ink pressure generated at this time, a part of ink filling up the ink chamber 5 is ejected as an ink droplet from the ink nozzle 11 communicating with this ink chamber 5. Since the greatest ink pressure can be generated at this time, the ink ejection quantity increases in comparison with that in the case where an ink droplet is ejected by driving the diaphragm 51 only with the main electrode 10.

Incidentally, while G>G2 is set in this embodiment, control is performed in the case of employing the configuration of G2>G, for example, in such a manner that only the main electrode 10 is driven at the time of ordinary ink ejection, and the electrodes 101 and 10 are driven simultaneously in the case where a large ink ejection quantity is required.

Even in the case where ink is ejected by the method shown in FIG. 15, if this is performed as a main operation and followed by the above-mentioned auxiliary operation, there is obtained an effect similar to the above-mentioned effect in which an ink column ejected from the ink nozzle 11 is separated to form an ink droplet stably. Further, in this case, it is possible to obtain an ink ejection quantity larger than the quantity of ink ejected by the operation described previously in FIG. 13, and it is possible to change the ink ejection quantity in accordance with the driving pattern. As a result, the size of each dot to be formed is changed in accordance with the driving pattern so that the density of the printing result can be changed, or printing with rich expression can be attained. In addition, since the bending speed of the diaphragm 51 is accelerated, the driving voltage may be reduced to obtain the same ink ejection quantity, so that the power consumption can be reduced.

Figure 16:
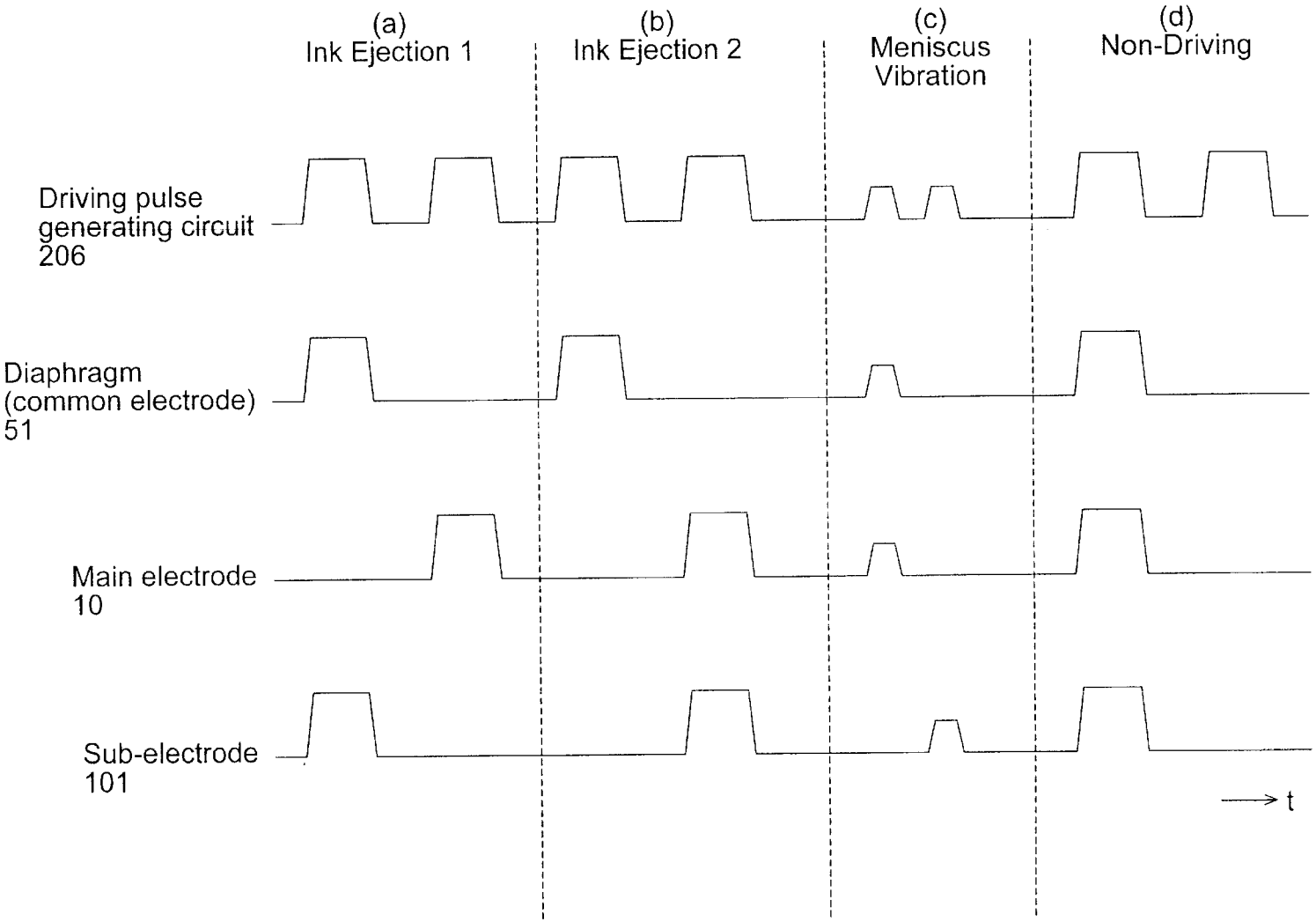
FIG. 16 is a timing chart showing an example of a driving pulse for the ink jet head according to the third embodiment.

FIG. 16 is a timing chart showing an example of a driving pulse applied to the ink jet head according to this embodiment. This driving pulse is generated by the above-mentioned voltage control circuit portion 21 in FIG. 7. Although this driving pulse is generated in the same manner as in the above-mentioned embodiments, the value of the driving voltage for the sub-electrode 101 is a little reduced here for the meniscus vibration.

In the timing chart of FIG. 16, the method for driving the ink jet head 1 is roughly classified into four driving patterns. In the driving pattern of Ink Ejection 1 shown in FIG. 16(*a*), an ink droplet is ejected by driving the diaphragm 51 by electric charge/discharge between the main electrode 10 and the diaphragm (common electrode) 51 (see FIG. 13). According to the illustrated waveform, the ink-droplet ejection is performed twice. In the driving pattern of Ink Ejection 2 shown in FIG. 16(*b*), electric charge/discharge is performed between the main electrode 10 and the diaphragm (common electrode) 51 and between the sub-electrode 101 and the diaphragm 51 simultaneously so that the whole surface of the diaphragm 51 is bent and driven (see FIG. 15). According to the illustrated waveform, the ink-droplet ejection is performed twice.

In the driving pattern of Meniscus Vibration of FIG. 16(c), the meniscus of the ink nozzle 11 is vibrated without ejecting any ink droplet, and the diaphragm 51 is driven by electric charge/discharge between the auxiliary electrode 101 and the diaphragm (common electrode) 51 (see FIG. 14). According to the illustrated waveform, the meniscus is vibrated twice. In the driving pattern shown in Non-Driving of FIG. 16(*d*), the diaphragm (common electrode) 51 and the electrodes 10 and 101 are turned on so that they are always kept in the same potential (see the state of FIG. 12). At this time, no ink droplet is ejected and no meniscus is vibrated.

Figure 17:
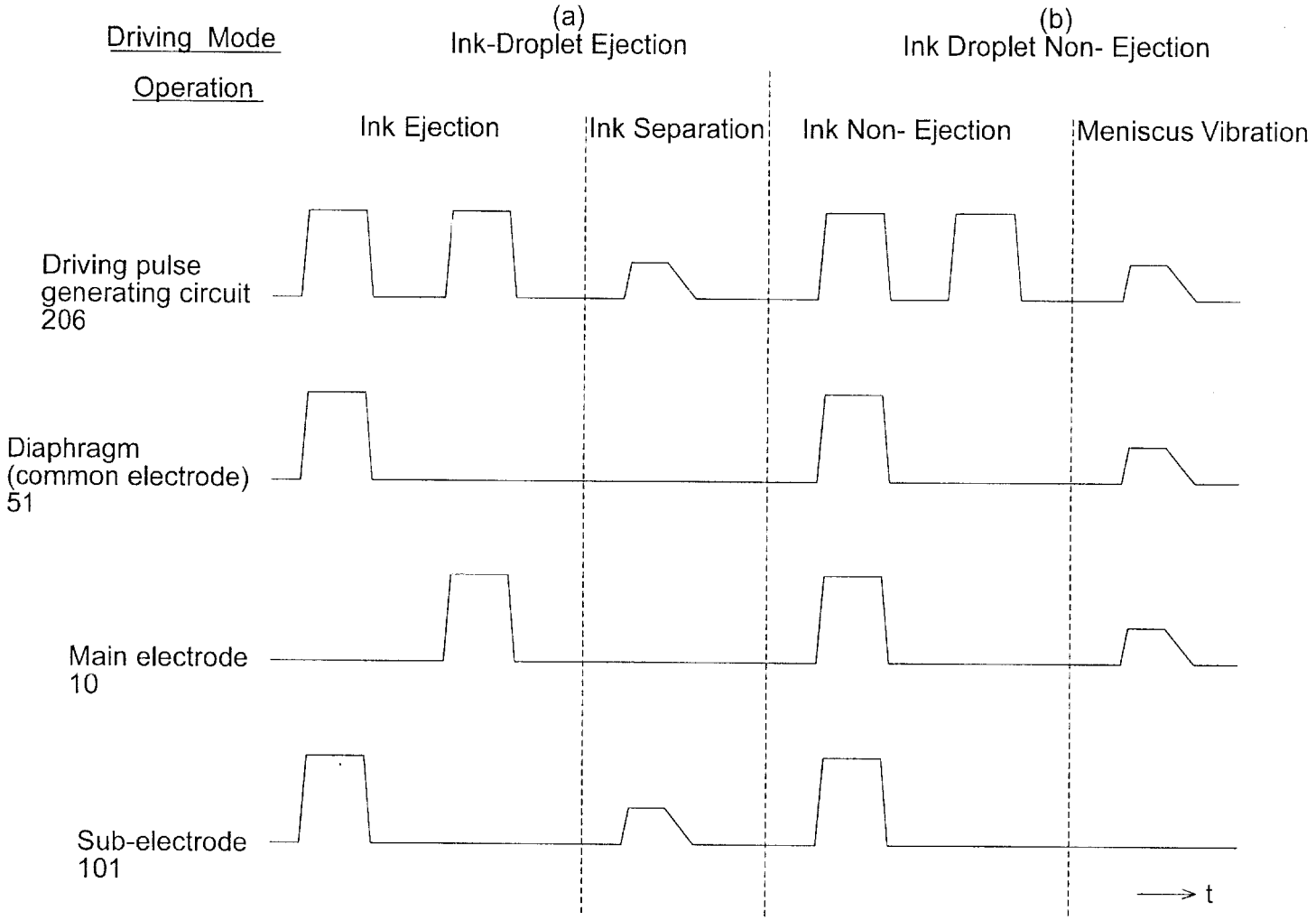
FIG. 17 is a timing chart showing an example of a driving mode of the ink jet head according to the third embodiment.

FIG. 17 is a timing chart showing driving modes and operations of ink corresponding thereto. These are examples of combinations of the driving patterns shown in FIG. 16. Here, two kinds of driving modes, that is, Ink Ejection and Ink Non-Ejection, are shown by way of example. In the driving mode of Ink-Droplet Ejection shown in FIG. 17(*a*), the ink ejection operation is performed twice, and succeedingly the operation for separating an ink column ejected in the second ink ejection is performed. As a result, ink droplets are formed and ejected so that one picture element is printed on the printing surface.

On the other hand, in the driving mode of Ink-Droplet Non-Ejection shown in FIG. 17(*b*), only the meniscus vibration is performed by driving only the sub-electrode 101 without ejecting any ink droplet. At this time, no picture element is printed on the printing surface. However, since the potential of the sub-electrode 101 is reversed, a charge between the sub-electrode 101 and the diaphragm (common electrode) 51 is prevented from accumulating. In addition, ink having increased viscosity caused by the long-term absence of ink ejection is diffused into the ink chamber 5 by the meniscus vibration, so that any failure in ink ejection can be prevented. When the driving mode of Ink Non-Ejection is formed of such a driving pattern, it is possible to refresh an electric charge between the sub-electrode 101 and the diaphragm (common electrode) 51 and refresh ink in the ink nozzle 11.

Incidentally, if the driving pulse for driving the sub-electrode 101 is so set as to be longer in discharge time and to have a waveform different from that of the driving pulse for driving the main electrode 10, the vibration of the meniscus is attenuated quickly after drawing-in of the meniscus. Then, the meniscus is restored to its stand-by position so as to be ready for the next driving of the main electrode 10. Thus, there is another effect that the ink jet head can be driven at a high driving frequency. This point will be described further in detail with reference to FIGS. 18 and 19.

Figure 18:
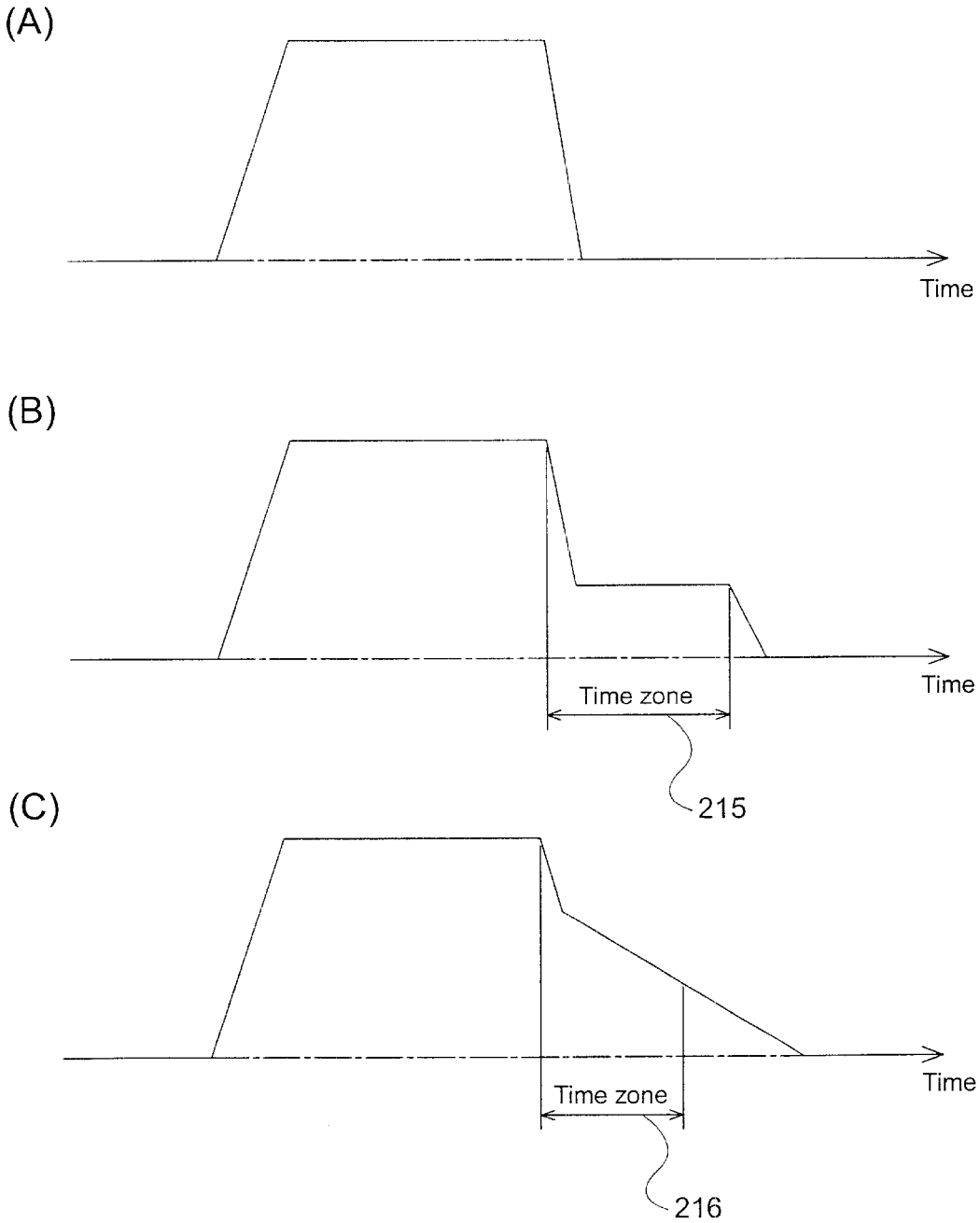
FIG. 18 is a timing chart showing another example of a driving pulse for the ink jet head according to the third embodiment.
Figure 19:
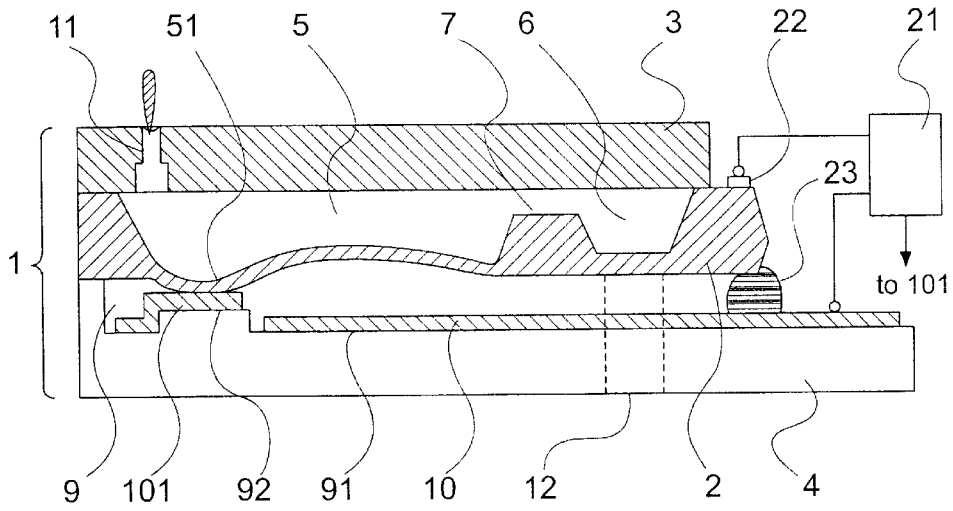
FIG. 19 is a partially sectional view of the ink jet head, showing the operation of the ink jet head when the driving pulse of FIG. 18 is applied.

Another method for driving the ink jet head according to the present invention will be described with reference to FIGS. 18 and 19. FIG. 18 shows an example of a voltage waveform applied between the sub-electrode 101 and the diaphragm (common electrode) 51. FIG. 19 is a partially sectional view of the ink jet head 1. FIG. 18(A) shows a voltage waveform which has been already described. With this voltage waveform, the diaphragm 51 discharges electricity on the main electrode 10 side and on the sub-electrode 101 side substantially simultaneously, so as to be restored to the original position of the diaphragm 51. If a voltage waveform shown in FIG. 18(B) or 18(C) is applied to the sub-electrode 101, the diaphragm 51 on the main electrode 10 side is restored to the original position thereof while the diaphragm 51 on the sub-electrode 101 side is left in contact therewith as shown in FIG. 19 during the time 215 or 216 in FIG. 18(*b*) or 18(*c*). As a result, the vibration of the meniscus after drawing-in of the meniscus is attenuated quickly so that the meniscus is restored to its stand-by position so as to be ready for the next driving of the main electrode 10. Thus, the ink jet head 1 can be driven at a high driving frequency. This fact similarly applies to the above-mentioned first and second embodiments, and a fifth embodiment which will be described later.

Embodiment 4

By the way, if each of the opposed electrodes is constituted by a main electrode and a sub-electrode as mentioned above, the shape of the main electrode is inevitably different from the shape of the sub-electrode. Therefore, the time constant of a circuit constituted by the main electrode and the common electrode is different from the time constant of a circuit constituted by the sub-electrode and the common electrode. Now, such an opposed electrode will be described as a fourth embodiment of the present invention, in consideration of the time constants of the circuits.

Figure 20:
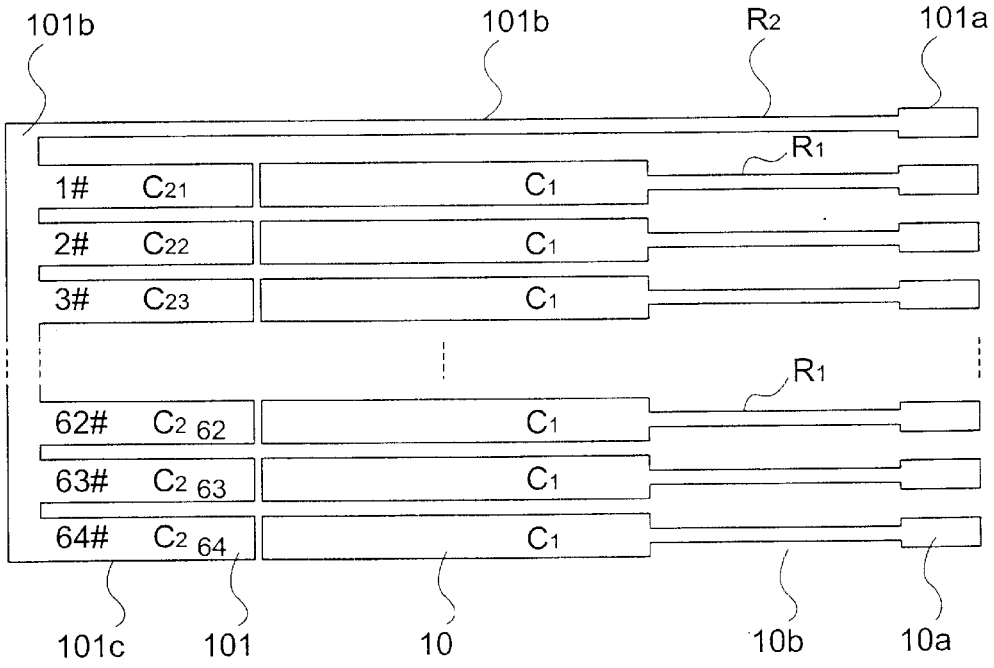
FIG. 20 is a plan view of opposed electrodes of the ink jet head according to the above-mentioned first to third embodiments.

FIG. 20 is a plan view of the opposed electrodes of an ink jet head according to the above-mentioned first to third embodiments. If the number of common sub-electrodes increases, the resistance value of the sub-electrodes increases. As a result, the time constant of a sub-electrode becomes very different from that of a main electrode. A time constant $\tau$ at the time of head driving (electric charge/discharge) is defined by the product of capacitance C of an electrostatic actuator (common electrode/opposed electrode) mounted on the ink jet head, and resistance R of an opposed electrode, mainly at the lead portion of the opposed electrode. That is, the time constant is expressed by $\tau=C\times R$. This time constant $\tau$ means a characteristic value representing a state of the electrostatic actuator charged with electric charges at the time of electric charge/discharge. This time constant $\tau$ also means a characteristic value representing a delay of operation time of the electrostatic actuator. Further, as shown in FIG. 20, when each of the electrostatic actuators is constituted by the main electrode 10 and the sub-electrode 101, the time constants of the respective actuators are expressed by:

The time constant of a circuit associated with the main electrode:

$$\tau 1=R1\times C1$$

The time constant of a circuit associated with the sub-electrode:

$$\tau 2=R2\times C2$$

Here, R1 and R2 designate resistance values of lead portions 10*b* and 10*b* of the electrodes 10 and 101 respectively, and C1 and C2 similarly designate electrostatic capacities of the electrodes 10 and 101 respectively. Further, the electrostatic capacity C2 of the sub-electrode 101 is the total sum of electrostatic capacities of respective auxiliary actuator portions, and it is expressed in the example of FIG. 20 as follows:

$$C2=C2_1+C2_2+\ldots+C2_{64}$$

Therefore, the time constant of the circuit associated with the main electrode 10 is inevitably different from the time constant of the circuit associated with the sub-electrode 101. In addition, the charging rate (that is, time constant) is different among the auxiliary actuator portions. The attraction (pressure) of an electrostatic actuator is defined by an electric charge accumulated (charged) in the actuator (capacitor). Therefore, if there is a delay of charging between the main electrode 10 and the sub-electrode 101, there is a fear of producing a difference in the attraction among the actuators.

This embodiment intends further improvement in view of such a point. In the present invention, the time constant $\tau 1$ of the circuit associated with the main electrode 10, the time constant $\tau 2$ of the circuit associated with the sub-electrode 101, and a difference $\Delta\tau$ between these time constants are defined in connection with the natural vibration period of the ink channel or the optimum driving pulse width. Here, the details of them will be described.

(a) Relationship between the natural vibration period (natural vibration frequency) of the ink channel and the driving speed for the diaphragm:

First, description will be made about the standard conditions required for driving an ink jet head using electrostatic actuators (with no auxiliary electrode) each having a basic configuration constituted by a main electrode. An ink channel of the ink jet head constitutes a vibration system by an inertance (mass component) of ink in an ink chamber forming the ink channel, a diaphragm, a channel wall, and a compliance (spring component) caused by the compression of ink. On the other hand, the electrostatic actuator is constituted by the diaphragm and an opposed electrode which is opposed to the diaphragm.

In the ink jet head having such a configuration, ink in this ink channel is vibrated by the electrostatic actuator and the diaphragm is driven at good timing so that an ink droplet is ejected. To vibrate the diaphragm, the electrostatic actuator is supplied with a driving pulse so as to perform electric charge/discharge. In detail, the process for driving the diaphragm and the electrostatic actuator are as follows.

When the diaphragm is attracted toward the opposed electrode by charging the electrostatic actuator, the vibration system of the ink channel responds thereto. The ink in the ink chamber starts to vibrate at a speed corresponding to the natural vibration frequency of the vibration system of the ink channel. If the charge charged in the electrostatic actuator is discharged at the time the pressure in the ink chamber reaches a maximum, the diaphragm can leave the opposed electrode because of the discharge of the electrostatic actuator. The leaving of the diaphragm from the opposed electrode and the succeeding ejection of an ink droplet are performed at a response speed corresponding to the natural vibration frequency of the vibration system of the ink channel in the same manner as in the case of attraction of the diaphragm.

Thus, when the diaphragm is driven, the driving (vibrating) speed for the diaphragm is defined by the response speed corresponding to the natural vibration frequency of the vibration system of the ink channel. Therefore, to drive the diaphragm in response to the vibration system of the ink channel, it is necessary that the speed of electric charge/discharge for the electrostatic actuator (that is, time constant $\tau$) is much higher (has a smaller value) than the response speed defined by the natural vibration frequency of the vibration system of the ink channel (that is, natural vibration period $T_0$). It was actually confirmed in experimental examples that when the natural vibration period $T_0$ of an ink channel was 30 $\mu$sec (33 kHz in the natural vibration frequency), the time constant $\tau$ representing a charging speed was 0.6 $\mu$sec at its center value, and 1.2 $\mu$sec at its maximum value which appeared due to the scattering in resistance values. At this time, the ink ejection quantity and the ink ejection speed were ensured to have sufficient values on ejecting the ink were not influenced by change of the time constant $\tau$. In these cases, the time constant $\tau$ was not more than 1/25 of the natural vibration period $T_0$ of the ink channel, satisfying the above-mentioned condition that the time constant $\tau$ of electric charge/discharge for the electrostatic actuator must be much smaller than the natural vibration period $T_0$ of the ink channel.

Thus, the conditions necessary for the relationship between the natural vibration period (frequency) of the ink channel and the driving speed of the diaphragm are described more specifically as follows.

1. The time constant $\tau$ the electrostatic actuator must be much smaller than the natural vibration period (frequency) $T_0$ of the ink channel.

$$T_0 >> \tau$$

2. In addition, at least the time constant $\tau$ of the electrostatic actuator is not more than 1/25 of the natural vibration period $T_0$ of ink.

$$(1/25)T_0 \geqq \tau$$

(b) Relationship between the optimum driving pulse width and the natural vibration period (frequency) of an ink channel:

Description will be made below about the relationship between the driving pulse width and the natural vibration period (frequency) of an ink channel in an ink jet head in the form where an electrostatic actuator is driven to eject an ink droplet from an ink nozzle.

The waveform of a driving pulse applied to the electrostatic actuator so as to drive the ink jet head for ejecting an ink droplet is formed according to the above-mentioned mentioned process for driving the ink jet head. That is, the driving waveform is constituted by the steps of:

1. Charging the electrostatic actuator so that the diaphragm is attracted toward an opposed electrode;

2. Holding an electric charge till the pressure of ink in an ink channel reaches a maximum by the response of the ink channel; and 3. Discharging the charges so that the diaphragm can leave the opposed electrode.

When the driving waveform is grasped as a driving pulse, the optimum driving pulse width Pws corresponds to the time of the steps 1 and 2 of the above-mentioned driving waveform formation. Here, the optimum driving pulse width Pws means the driving pulse width Pw at the time when the ink-droplet ejection quantity increases to a maximum. Next, the relationship will be described further in detail.

As described in the above-mentioned process for driving the ink jet head, the optimum driving pulse width Pws is not longer than the time which is the sum of both 1/4 of the natural vibration period of the ink channel at the time when the diaphragm is in contact with the opposed electrode, and the time during which the diaphragm is attracted and reaches the opposed electrode. The time required for the diaphragm to reach the opposed electrode is not longer than 1/4 of the natural vibration period of the ink channel. Here, the natural vibration period of the ink channel during standby time of the diaphragm is different from that at the time when the diaphragm is in contact with the opposed electrode. That is, the former is a natural vibration period of a vibration system of the ink channel including the diaphragm while the latter is a natural vibration period of another vibration system not including the diaphragm as compliance (spring component). In the examples carried out, the natural vibration frequency of the ink channel at the time when the diaphragm was in contact with the opposed electrode was 133 kHz (7.5 $\mu$sec in the natural period). The natural vibration period at the time when the diaphragm is in contact with the opposed electrode is much shorter than that at the time when the diaphragm stands by. Therefore, the optimum driving pulse width Pws substantially corresponds to the time during which the diaphragm is attracted and reaches the opposed electrode. It is understood that this is the time associated with the response time of the ink channel, that is the natural vibration period of the ink channel.

In the examples carried out, the optimum driving pulse width Pws was 12 $\mu$sec. In comparison with the natural vibration period as a standard, this optimum driving pulse width Pws is about 1/2.5 of the natural vibration period $T_0$ of the ink channel. As a result, on the assumption that the time constant $\tau$ of the electrostatic actuator must be not more than 1/30 of the optimum driving pulse width Pws (as a comparison standard) (on the assumption that the object in comparison is the natural vibration period of the ink channel), the time constant $\tau$ must similarly be not more than 1/75 of the natural vibration period. In the same manner, on the assumption that the time constant $\tau$ of the electrostatic actuator must be not more than 1/25 of the natural vibration period (frequency), the time constant $\tau$ must similarly be not more than 1/10 of the optimum driving pulse width Pws. Thus, the time constant $\tau$ can be defined in connection with the natural vibration period (frequency) or the optimum driving pulse width Pws. Then, as mentioned above, both the natural vibration period $T_1$ (frequency) and the optimum driving pulse width Pws are proper to the ink channel of the ink jet head.

(c) Time constant $\tau$ of the electrostatic actuator

In the present invention where an opposed electrode of an electrostatic actuator for driving a channel is divided into a main electrode and a sub-electrode, the conditions required for establishing the above-mentioned relationship among the time constant $\tau$ of the electrostatic actuator, the natural vibration period $T_0$ of the ink channel and the optimum driving pulse width Pws can be arranged as follows.

(1) Each of the time constants τ1 and τ2 of the main electrode and the sub-electrode is much smaller than the natural vibration period $T_0$ of the ink channel.

(2) Each of the time constants τ1 and τ2 of the main electrode and the sub-electrode is not more than 1/25 of the natural vibration period $T_0$ of the ink channel.

(3) Each of the time constants τ1 and τ2 of the main electrode and the sub-electrode is not more than 1/10 of the optimum driving pulse width Pws.

(4) A difference Δτ between the respective time constants of the main electrode and the sub-electrode is much smaller than the natural vibration period $T_0$ of the ink channel.

lead portion of a sub-electrode is formed of a thin film of gold, and No. 3 is an example in which lead portions of the main electrode and the sub-electrode respectively are formed of a thin film of gold. In addition, the planar shapes of the opposed electrodes of the ink jet head used at this time are just as shown in FIG. 20 which will be described later. The natural vibration period $T_0$ is 30 μsec (natural vibration frequency: 33 KHz), and the optimum driving pulse width Pws is 12 μsec.

In addition, Table 2 shows the results of comparison in which the findings of Table 1 are compared with the respective time constants, and the natural vibration period $T_0$ and optimum driving pulse width Pws of the above-mentioned ink jet head. Table 2 shows the findings of the relationship between the difference Δτ and the existence of influence.

TABLE 2

Comparison Results of Time Constants and Their Differences, with $T_0$ and Pws

| Comparison object time constant | $T_0$ | | | Pws | | | existence |
|---|---|---|---|---|---|---|---|
| component No./ | τ1 | τ2 | Δτ | τ1 | τ2 | Δτ | of influence |
| 1 | 1/50 | 1/1.4 | 1/1.5 | 1/20 | 1/0.5 | 1/0.5 | x |
| 2 | ↑ | 1/140 | 1/75 | ↑ | 1/56 | 1/30 | ○ |
| 3 | 1/5000 | ↑ | 1/150 | 1/2000 | ↑ | 1/60 | ○ |

(5) The difference Δτ between the respective time constants of the main electrode and the sub-electrode is not more than 1/75 of the natural vibration period of the ink channel.

(6) The difference Δτ between the respective time constants of the main electrode and the sub-electrode is not more than 1/30 of the optimum driving pulse width Pws for the ink channel.

(7) The difference Δτ between the respective time constants of the main electrode and the sub-electrode is not more than 0.4 μsec.

Although attention is paid to the time constants τ1 and τ2 per se of the main electrode and the sub-electrode in the above conditions (1) to (3), the difference Δτ reducing the time constants. In addition, the time delay among the operations of the sub-electrodes is also settled within a predetermined range. Incidentally, the basis for 0.4 μsec or less in the above-mentioned condition (7) is shown in the following Table 1.

The following Table 1 shows the results of calculation of differences between time constants, and the findings of the influence of the differences.

Next, description will be made about the configuration of the opposed electrodes for obtaining the time constants τ1 and τ2 and their difference Δτ satisfying the above-mentioned conditions (1) to (7).

(a) To lower the time constants τ1 and τ2 of circuits associated with the main electrode and the sub-electrode.

The lead portions of both the electrodes are formed of metal material. The lead portions are formed, for example, of gold thin film/chromium (or titanium) thin film, or aluminum thin film, so that resistance values R of the lead portions are reduced. In addition, the lead portions are increased in thickness or in width so that the resistance values R are reduced.

(b) To lower the time constant τ2 of the sub-electrode.

In this case, either or both of a resistance value R and an electrostatic capacity C of the sub-electrode are reduced. To lower the resistance value R, the lead portion of the sub-electrode is formed in the same manner as in the above-mentioned configuration (a). On the other hand, to lower the electrostatic capacity C, the sub-electrode is divided in parallel or divided in series, or divided both in parallel and in series.

TABLE 1

Results of Calculation of Differences between Time Constants and Findings of the Influence of the Differences

| Parameter component No./ | R1 (kΩ) | C1 pF) | R2 kΩ) | C2 (pF) | τ1 (μsec) | τ2 (μsec) | Δτ (μsec) | existence of influence |
|---|---|---|---|---|---|---|---|---|
| 1 | 9.1 | 67.2 | 16.3 | 1309.7 | 0.6 | 21.3 | 20 | x |
| 2 | ↑ | ↑ | 0.163 | ↑ | 0.6 | 0.213 | 0.387 | ○ |
| 3 | 0.091 | ↑ | ↑ | ↑ | 0.006 | ↑ | 0.207 | ○ |

The above-mentioned component No. 1 is an example in which opposed electrodes are formed of only ITO (corresponding to FIG. 20), No. 2 is an example in which a FIGS. 21(A) and (B) are a plan view of the opposed electrodes (first example) and a sectional view taken on line B—B thereof. In this example, a terminal portion 10*a* and a lead portion 10*b* of the main electrode 10 are manufactured in such a manner that metal material such as chromium (or titanium) is sputtered to form a chromium (titanium) thin film 105, and gold (Au) is sputtered to form a gold thin film 106 on the chromium (titanium) thin film 105. An opposed electrode portion 10*c* of the main electrode 10 is manufactured in such a manner that ITO is sputtered to form an ITO thin film 107. A terminal portion 101*a* and a lead portion 101*b* of the sub-electrode 101 are also manufactured in such a manner that chromium (or titanium) is sputtered to form a chromium (titanium) thin film 105 (for example, about 0.03 μm thick), and gold (Au) is sputtered to form a gold thin film 106 (for example, about 0.1 μm thick) on the chromium (titanium) thin film 105. An opposed electrode portion 101*c* of the sub-electrode 101 is manufactured in such a manner that ITO is sputtered to form an ITO thin film 107.

Here, as shown in FIG. 21(C), the main electrode 10 is formed such that the terminal portion 10*a* and lead portion 10*b* thereof are formed followed by forming the opposed electrode portion 10*c*. With this manufacturing process of the main electrode 10, the ITO thin film 107 is directly connected to the gold thin film 106, which enables to reduce resistance value of a connecting portion therebetween and to enhance reliability thereof. On the other hand, when the opposed electrode portion 10*c* is formed followed by forming the terminal and lead portions 10*a* and 10*b*, the ITO thin film 107 is securely connected to the gold thin film 106 via the chromium (titanium) thin film 105.

Since the terminal portion 10*a* and the lead portion 10*b* of the main electrode 10 and the terminal portion 101*a* and the lead portion 101*b* of the sub-electrode 101 are formed of metal material, the resistance values R of the respective portions are reduced. As a result, the respective time constants $\tau 1$ and $\tau 2$ of the circuits associated with the main electrode 10 and the sub-electrode 101 are reduced. As a result, the difference $\Delta\tau$ is also reduced.

Incidentally, an aluminum thin film may be provided instead of the above-mentioned chromium (titanium) and gold thin films (this point similarly applies to examples which will be described later). In addition, since the chromium (or titanium) thin film 105 is put between the glass substrate 4 and the gold thin film 106 in the above-mentioned example, the gold thin film 106 is hardly peeled off from the glass substrate 4. In addition, since the opposed electrode portions 10*c* and 101*c* are formed of the ITO thin film 107, insulation breakdown or adhesion to the diaphragm 51 is hardly caused in them. In addition, since the resistance values R are reduced, the wiring pitch of the main electrode 10 and the sub-electrode 101 can be set to be fine. In addition, although the lead portion 101*b* of the sub-electrode 101, including both portions extending in the lengthwise and perpendicular direction of the ink chamber 5 is formed of a metal thin film in the above-mentioned example, only one of the both portions may be formed of the same (this fact similarly applies to examples of FIGS. 22 to 25 which will be described later).

However, if the whole of the lead portion 101*b* is formed of a metal thin film, the resistance value R thereof accordingly becomes much lower, so as to cause the advantage that the wiring pitch is made so fine that a larger number of sub-electrodes 101 can be formed, or the transparency of ITO can be further increased, ITO having the characteristic that the resistance value R thereof increases with the increase of the transparency thereof. In addition, from the point of view for lowering the time constant of the circuit associated with the sub-electrode 101, only the lead portion 101*b* may be formed of a metal film while the lead portion 10*b* may be formed of ITO.

Furthermore, the lead portions 10*b* and 101*b*, which are patterned on the glass substrate 4 by etching process, have a surface smoother than that of the ITO thin film. This improves wetting between the lead portion and the air-tight sealing portion 23, and also increases the adhesive area therebetween, whereby increasing the adhesive strength therebetween. As a result, it is possible to obtain high air tightness and durability of the electrostatic actuator.

Figure 22:
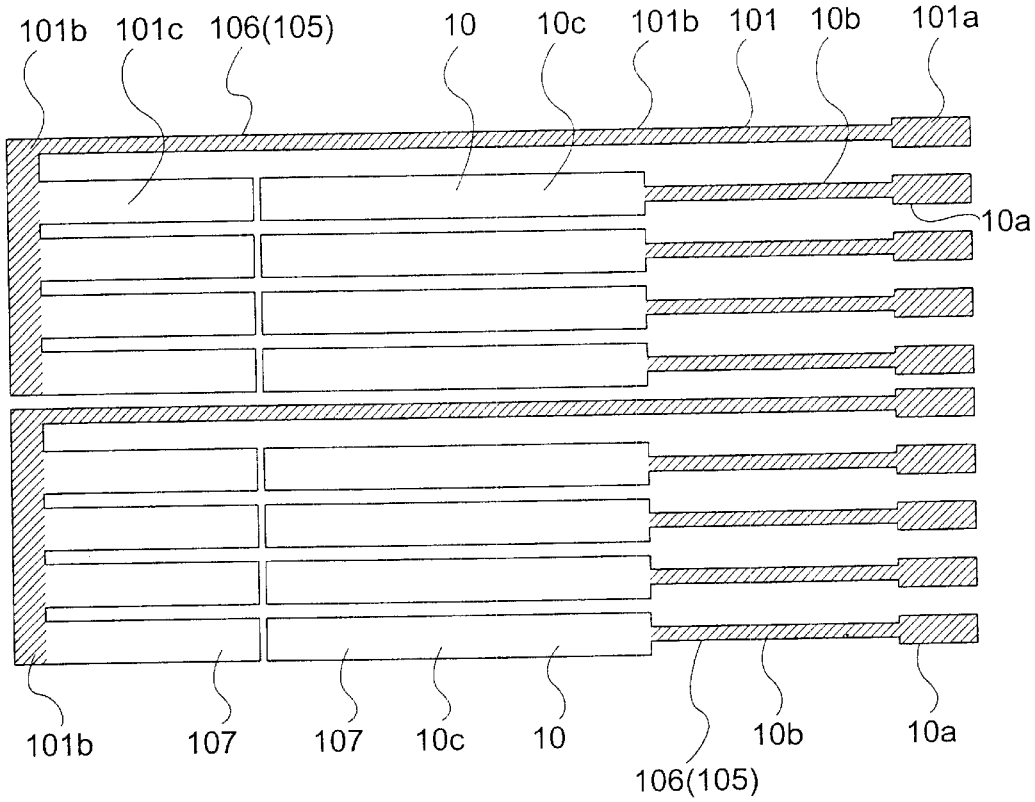
FIG. 22 is a plan view of opposed electrodes (second example) according to the fourth embodiment.

FIG. 22 is a plan view of the opposed electrodes (second example). In this example, by dividing a sub-electrode 101 in parallel, an area of the sub-electrode 101 is reduced so that the electrostatic capacity C thereof is reduced. Further, in addition thereto, the terminal portion 10*a* and the lead portion 10*b* of the main electrode 10 and the terminal portion 101*a* and the lead portion 101*b* of the sub-electrode 101 are formed of a chromium thin film 105 and a gold thin film 106 formed thereon, so that the resistance values R of the respective portions are reduced. Thus, the time constants $\tau 1$ and $\tau 2$ of the circuits associated with the main electrode 10 and the sub-electrode 101 respectively are reduced. As a result, the difference $\Delta\tau$ is also reduced.

Figure 23:
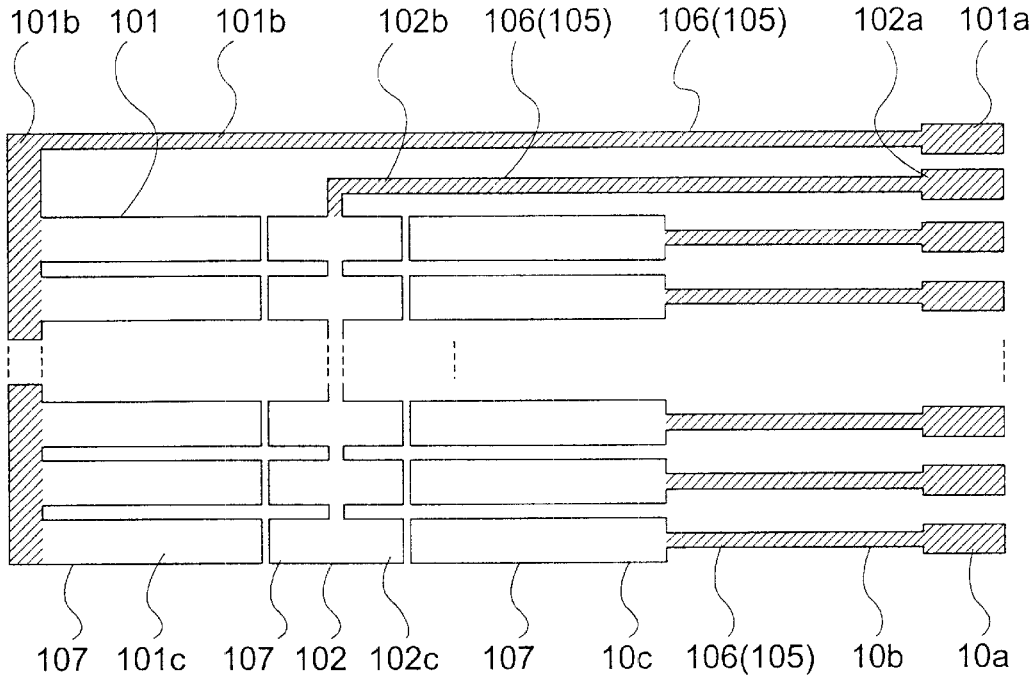
FIG. 23 is a plan view of opposed electrodes (third example) according to the fourth embodiment.

FIG. 23 is a plan view of the opposed electrodes (third example). In this example, a sub-electrode is divided in series so that a sub-electrode 101 and a second sub-electrode 102 are formed, and the areas of the respective sub-electrodes 101 and 102 are reduced so that the electrostatic capacity C is reduced. Further, in the same manner as in the above-mentioned examples, the resistance values R are reduced. Thus, the time constants $\tau 1$, $\tau 2$ and $\tau 3$ of the circuits associated with the main electrode 10, the sub-electrode 101 and the second sub-electrode respectively are reduced. As a result, the difference $\Delta\tau$ is also reduced.

Figure 24:
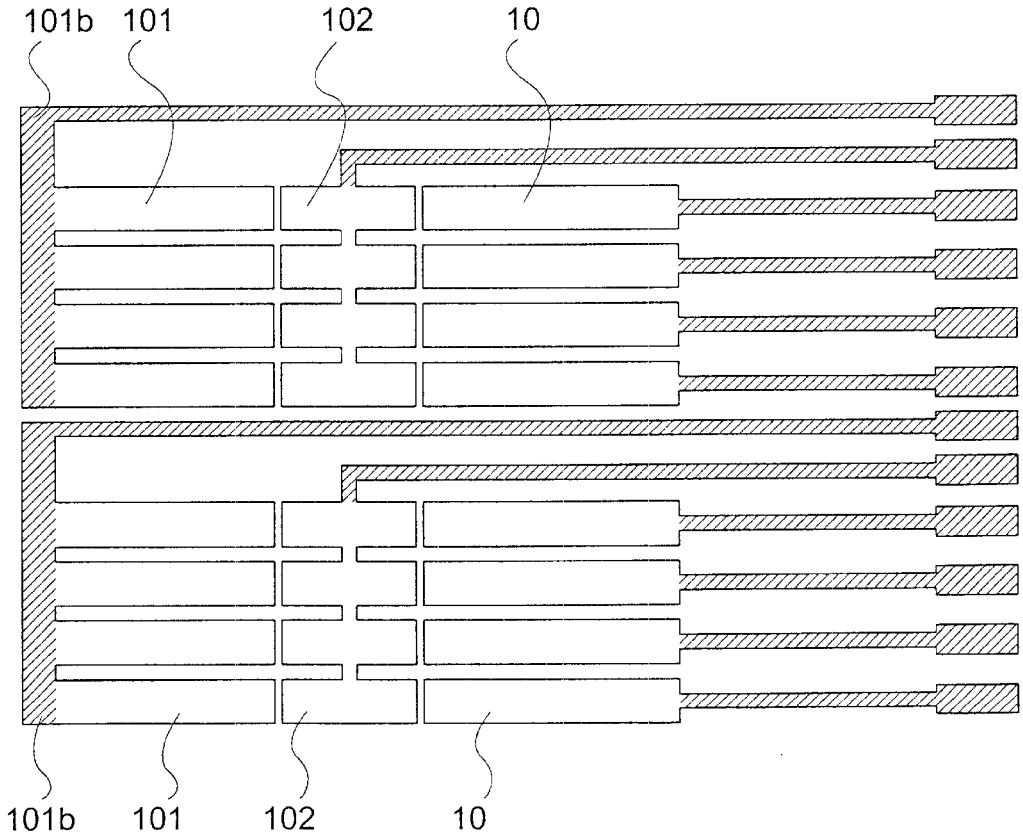
FIG. 24 is a plan view of opposed electrodes (fourth example) according to the fourth embodiment.

FIG. 24 is a plan view of the opposed electrodes (fourth example). In this example, a sub-electrode 101 is divided in series and in parallel, and the respective areas of the sub-electrode 101 and the second sub-electrode 102 are reduced so that the electrostatic capacity C is reduced. Further, in the same manner as in the above-mentioned examples, the resistance values R are reduced. As a result, the time constants $\tau 1$, $\tau 2$ and $\tau 3$ in the circuits associated with the main electrode 10, the sub-electrode 101 and the second sub-electrode 102 respectively are reduced, so that the difference $\Delta\tau$ is also reduced.

Figure 25:
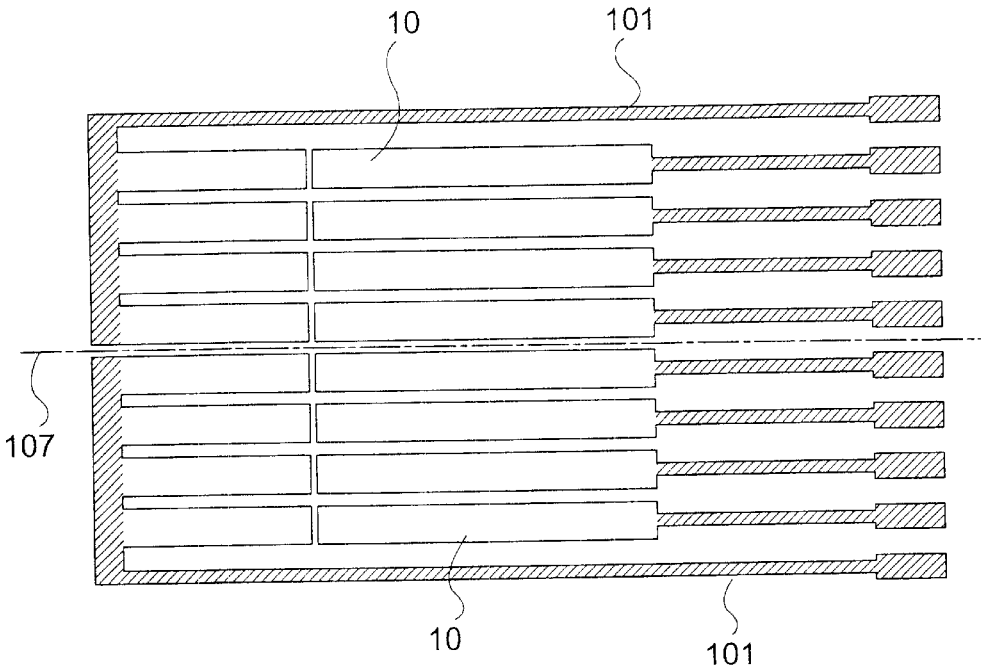
FIG. 25 is a plan view of opposed electrodes (fifth example) according to the fourth embodiment.

FIG. 25 is a plan view showing an example of arrangement of the opposed electrodes (fifth example). In this example, the opposed electrodes in FIG. 22 are arranged to be symmetrical about a boundary line 107 between adjacent units. This arrangement in FIG. 25 may be similarly applied to the above-mentioned example in FIG. 24. When the opposed electrodes are arranged thus and the main electrodes 10 grouped in two units are disposed in parallel, patterns with one and the same pitch are laid without putting any sub-electrode 101 therebetween. Accordingly, there is an advantage that it is easy to manufacture this arrangement.

While, the main electrode 10 and sub-electrode 101 of the above embodiments have the terminal portions 10*a*, 101*a* and lead portions 10*b*, 101*b* constituted by laminating the gold thin film 106 on the chromium (or titanium) thin film 105.

These terminal and lead portions may be a single thin film or multiple films of a metal or metals which exhibit high adhesion to the glass substrate 4. Such metals include chromium, titanium, platinum, aluminum and the like.

Where the terminal portions 10*a*, 101*a* and lead portions 10*b*, 101*b* are formed of a rare metal such as gold, platinum or the like, it is possible to form a reliable electrode with an excellent corrosion resistance. On the other hand, if these portions are formed of such a metal as aluminum having a high adhesion to the glass substrate 4, it enables to manufacture the electrode inexpensively and easily.

Incidentally, Pyrex glass may be used as the glass substrate 4, and instead, a silicon substrate may also be used. When the silicon substrate is used, since it is the same material as that of the silicon substrate 2 and the flatness thereof can easily be assured, distortion due to thermal expansion during adhering process of the substrates 2 and 4 can be minimized.

In this case, a metal thin film for the terminal and lead portions 10*a*, 101*a*, 10*b* and 101*b* can be deposited directly on a Pyrex glass or silicon substrate. However, the metal thin film may be deposited on a silicon deoxide film formed on the substrate, wherein the silicon deoxide film serves as a passivation film on the substrate to avoid adverse affects caused by impurity of the substrate material. In either cases, the metal thin film formed of gold has poor adhesion to a Pyrex glass substrate and to a silicon substrate. Thus, it is preferable that chromium, titanium and the like is used to form a adhesion promoter as in the above-mentioned embodiments.

Figure 21:
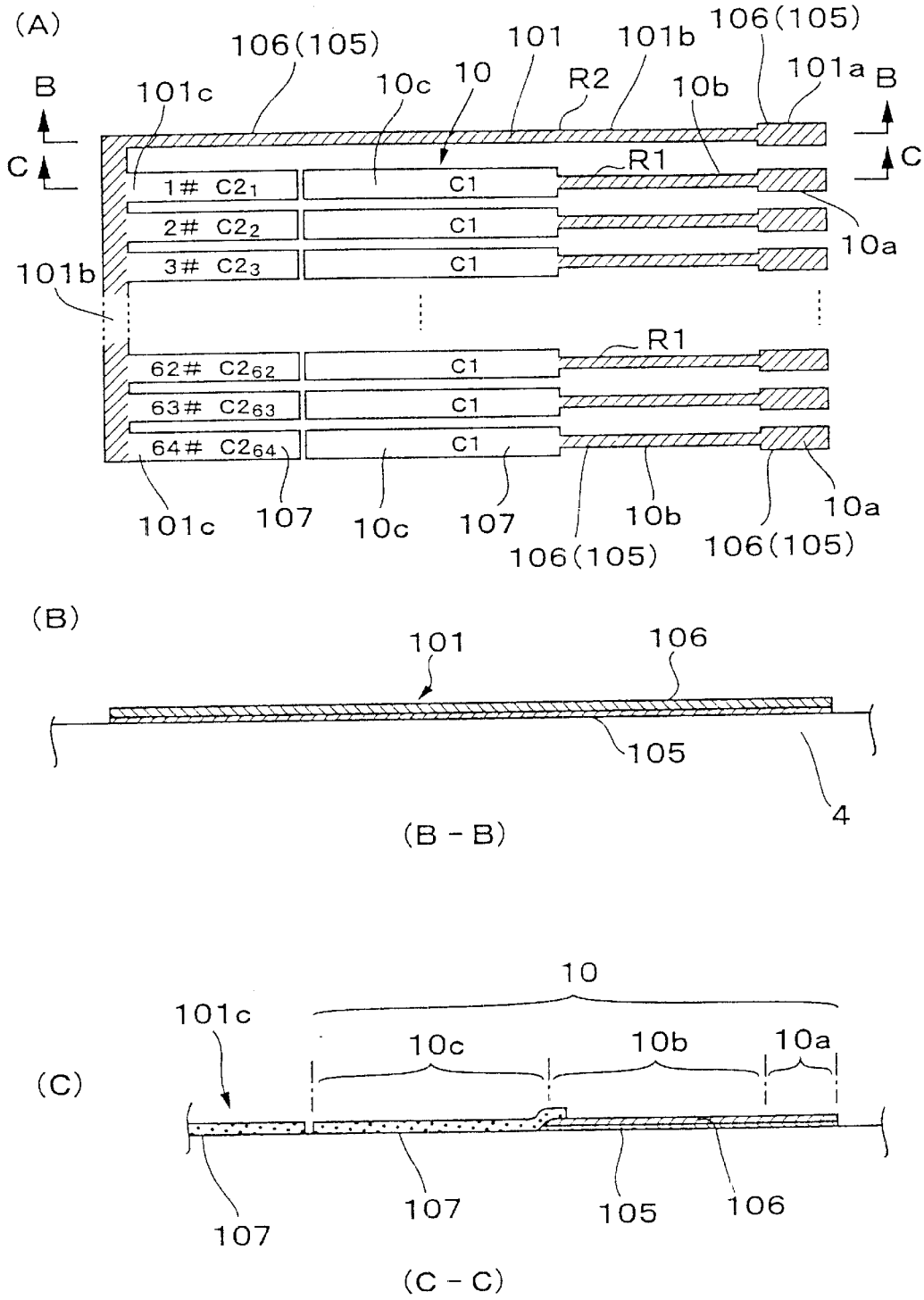
FIGS. 21(A), 21(B) and 21(C) are a plan view of opposed electrodes (first example) according to a fourth embodiment of the present invention, a sectional view of the sub-electrode thereof taken along line B—B of FIG. 21(A), and a sectional view of the main electrode thereof taken along line C—C of FIG. 21(A).

The above-mentioned opposed electrodes (the main electrode 10 and the sub-electrode 101) in FIGS. 21, 22 and 25 may be applied to the above-mentioned first to third embodiments directly. Next, description will be made about a fifth embodiment of the present invention to which the opposed electrodes in FIG. 24 are applied.

Embodiment 5

Figure 26:
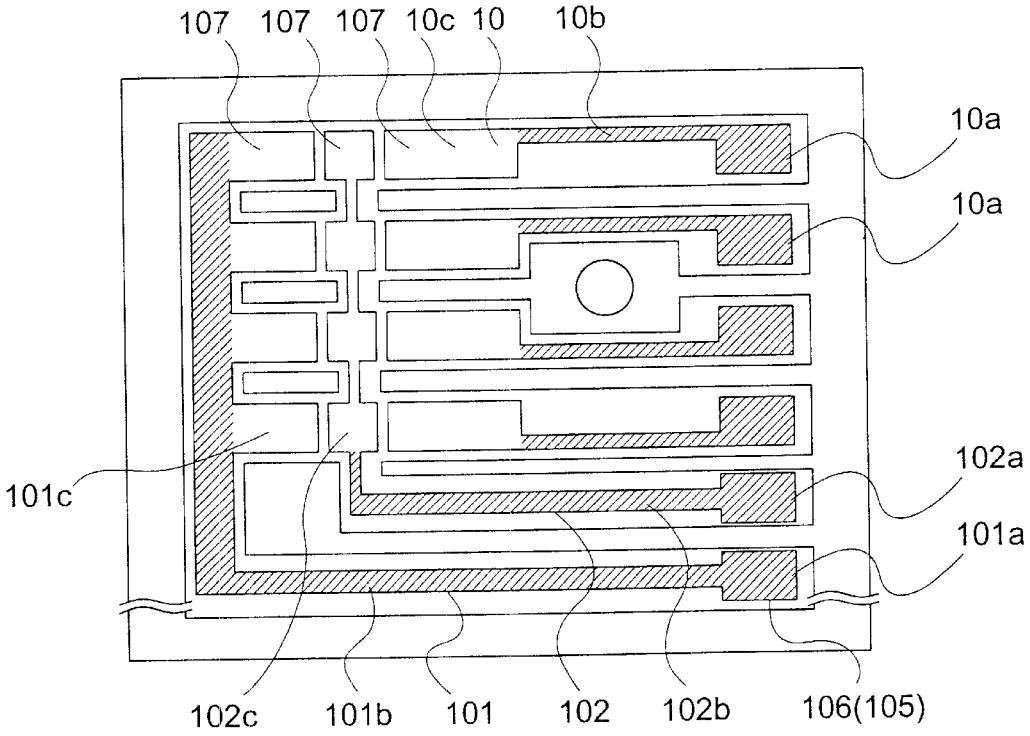
FIG. 26 is a plan view of a glass substrate of an ink jet head according to a fifth embodiment of the present invention.
Figure 27:
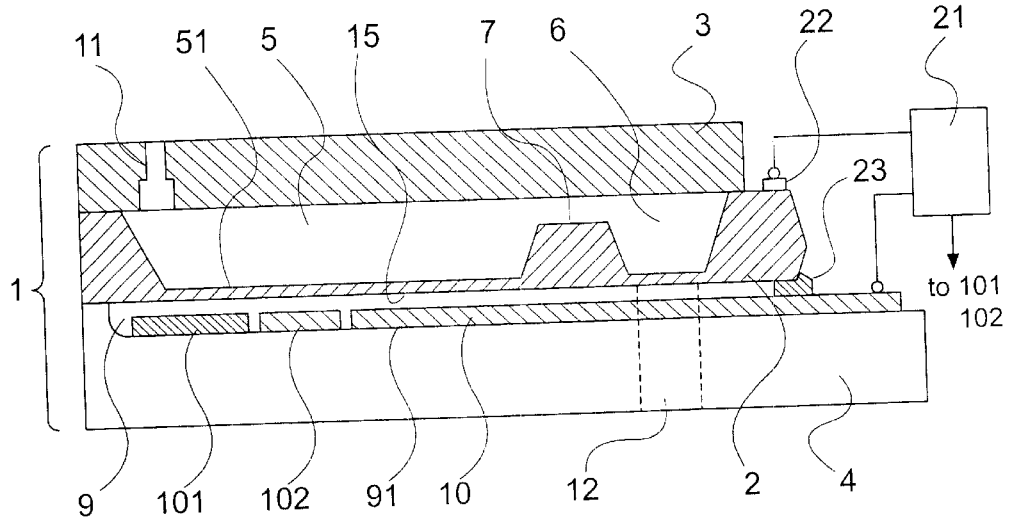
FIG. 27 is a partially sectional view of the ink jet head according to the fifth embodiment.

FIG. 26 is a plan view of a glass substrate of an ink jet head according to the fifth embodiment of the present invention. FIG. 27 is a partially sectional view of the same. In this embodiment, the opposed electrodes are constituted by main electrodes 10, a sub-electrode 101 and a second sub-electrode 102. A terminal portion 102*a* and a lead portion 102*b* of this second sub-electrode 102 have a configuration in which a chromium thin film and a gold thin film are laminated, in the same manner as in the sub-electrode 101. The time constant of a circuit constituted by the second sub-electrode 102 and a diaphragm (common electrode) 51, the time constant of a circuit constituted by the main electrode 10 and the diaphragm (common electrode) 51, and the time constant of a circuit constituted by the auxiliary electrode 101 and the diaphragm (common electrode) 51 are designed to satisfy the above-mentioned conditions (1) to (7) about time constants.

Figure 28:
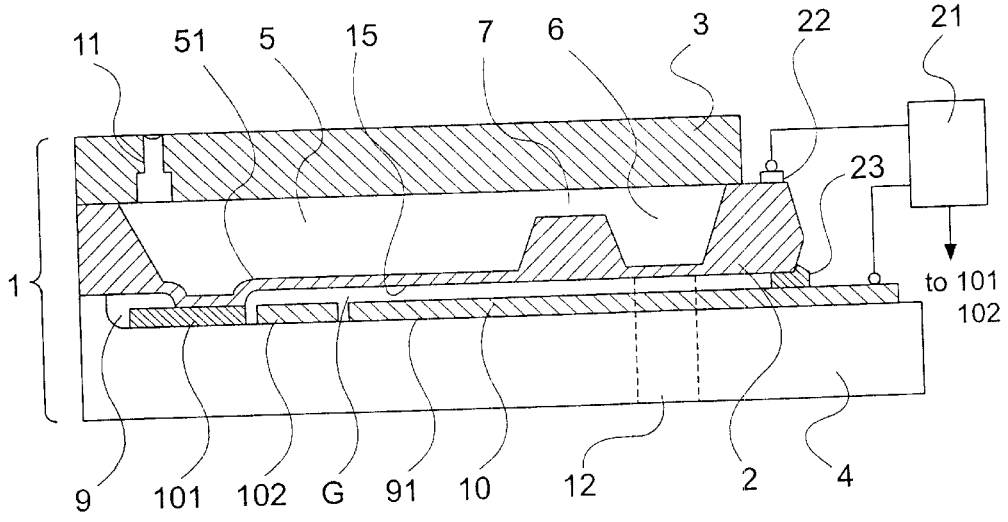
FIG. 28 is a partially sectional view of the ink jet head according to the fifth embodiment (Meniscus vibration).

FIG. 28 is a partially sectional view of the ink jet head (see Meniscus Vibration shown in FIG. 32 which will be described later). Here, a driving voltage is applied between the sub-electrode 101 and the diaphragm (common electrode) 51 so that vibration is given to the diaphragm 51 corresponding to the sub-electrode 101 by electric charge/discharge between the electrodes 101 and 51. Thus, menisci of the ink nozzles 11 are vibrated.

Figure 29:
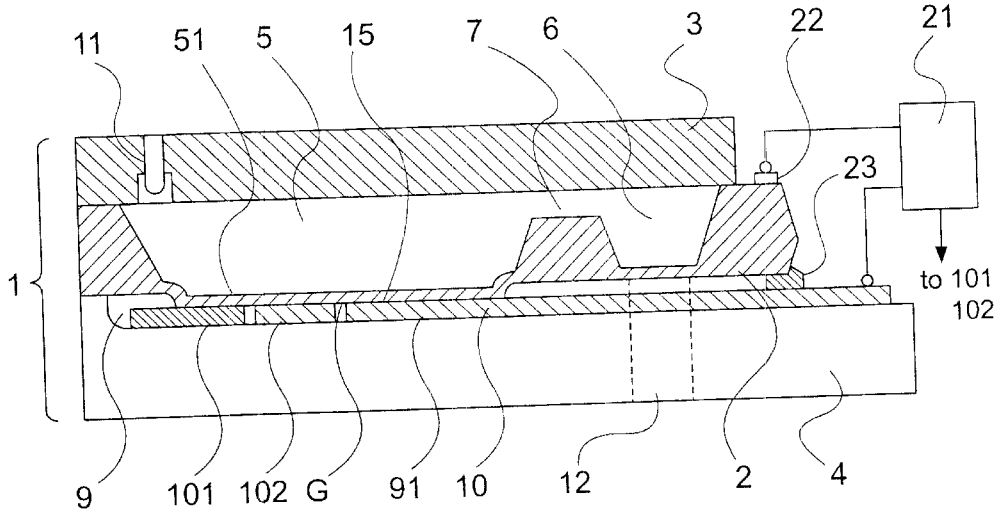
FIG. 29 is a partially sectional view of the ink jet head according to the fifth embodiment (Ink Ejection 1).

FIG. 29 is a partially sectional view of the ink jet head (see Ink Discharge 3 shown in FIG. 32 which will be described later). Here, a driving voltage is applied between all of the main electrode 10, the sub-electrode 101 and the second sub-electrode 102, and the diaphragm 51 at the same time so that the main electrode 10, the sub-electrode 101 and the second sub-electrode 102 function as one opposed electrode as a whole. As a result, the whole surface of the diaphragm 51 is bent by electric charge/discharge between all of the electrodes 10, 101 and 102, and the diaphragm 51, so that the displacement volume of the diaphragm 51 becomes maximum. Thus, the ink ejection quantity becomes maximum.

Figure 30:
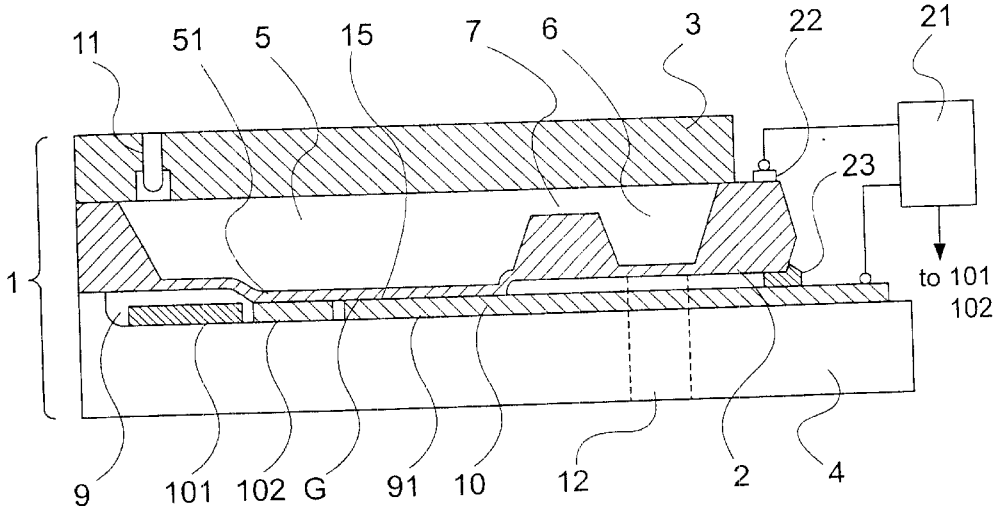
FIG. 30 is a partially sectional view of the ink jet head according to the fifth embodiment (Ink Ejection 2).

FIG. 30 is a partially sectional view of the ink jet head (see Ink Discharge 2 shown in FIG. 32 which will be described later). Here, a driving voltage is applied between both main electrode and the second sub-electrode 102, and the diaphragm 51 at the same time so that the main electrode 10 and the second sub-electrode 102 function as one opposed electrode as a whole. As a result, the diaphragm 51 corresponding to the main electrode 10 and the second sub-electrode 102 is bent by electric charge/discharge between the electrodes 10 and 102, and the diaphragm 51 so that the displacement volume of the diaphragm 51 becomes medium. Thus, the ink ejection quantity becomes medium.

Figure 31:
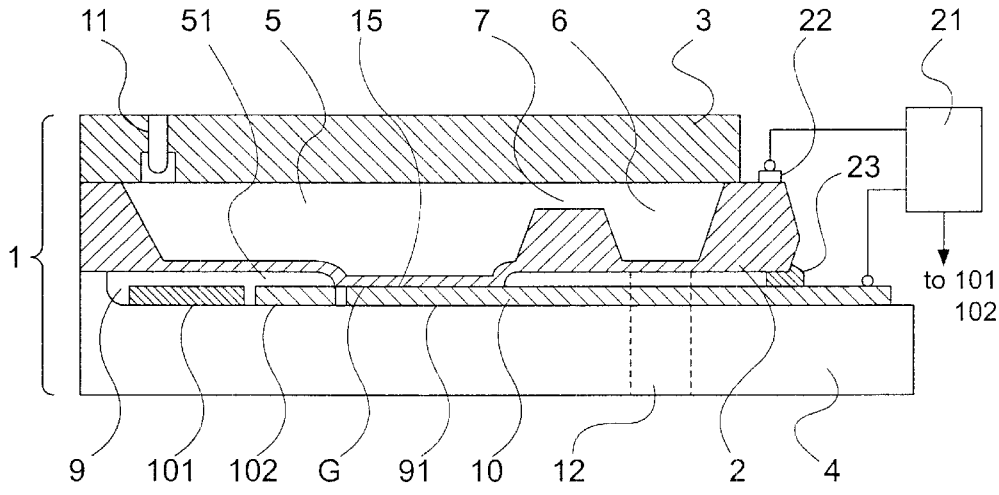
FIG. 31 is a partially sectional view of the ink jet head according to the fifth embodiment (Ink Ejection 3).

FIG. 31 is a partially sectional view of the ink jet head (see Ink Discharge 3 shown in FIG. 32 which will be described later). Here, a driving voltage is applied between the main electrode 10 and the diaphragm (common electrode) 51 so that only the main electrode 10 functions as an opposed electrode. As a result, the diaphragm 51 corresponding to the main electrode 10 is bent by electric charge/discharge between the electrode 10 and the diaphragm 51 so that the displacement volume of the diaphragm 51 becomes minimum. Thus, the ink ejection quantity becomes minimum.

Figure 32:
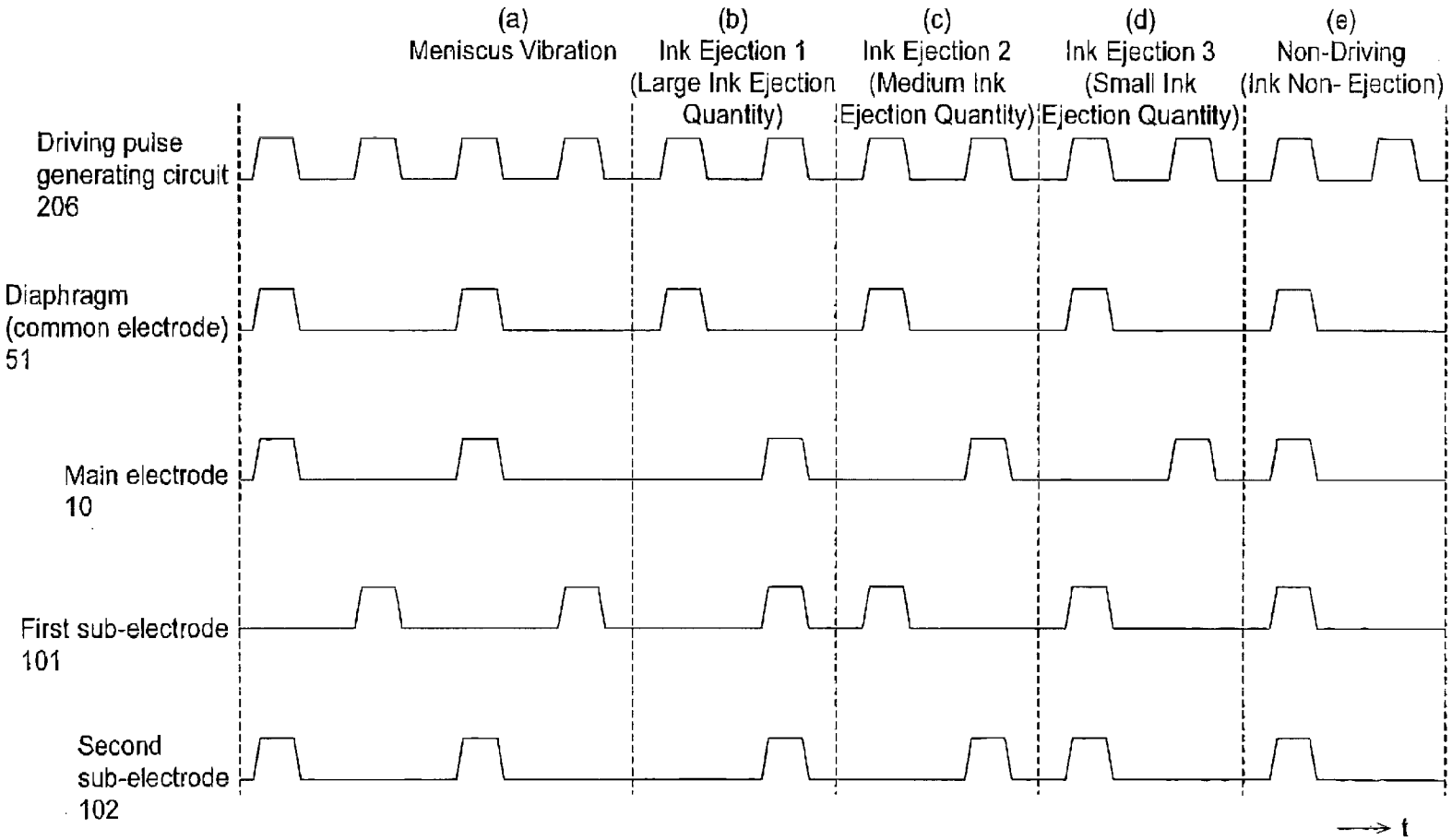
FIG. 32 is a timing chart showing the waveforms of a driving pulse in the ink jet head according to the fifth embodiment.

FIG. 32 is a timing chart showing an example of a driving pulse for the ink jet head according to this embodiment. Here, the method for driving the ink jet head is roughly classified into five driving patterns. In the driving pattern of Meniscus Vibration shown in FIG. 32(*a*), the driving pulse is applied between the sub-electrode 101 and the diaphragm (common electrode) 51 so as to give vibration to the diaphragm 51 corresponding to the sub-electrode 101. Thus, the menisci are vibrated (see FIG. 28).

In Ink Ejection 1 shown in FIG. 32(*b*), the driving pulse is applied to the main electrode 10, the sub-electrode 101 and the second sub-electrode 102 simultaneously so that the electrodes 10, 101 and 102 function as one opposed electrode as a whole. As a result, the displacement volume of the diaphragm 51 becomes maximum so that the ink ejection quantity becomes maximum (see FIG. 29).

In Ink Ejection 2 shown in FIG. 32(*c*), the driving pulse is applied to the main electrode 10 and the second sub-electrode 102 simultaneously so that the electrodes 10 and 102 function as one opposed electrode when ink is ejected. As a result, the displacement volume of the diaphragm 51 becomes medium so that the ink ejection quantity becomes medium (see FIG. 30).

In Ink Ejection 3 shown in FIG. 32(*d*), the driving pulse is applied to the main electrode 10 so that only the main electrode 10 functions as an opposed electrode when ink is ejected. As a result, the displacement volume of the diaphragm 51 becomes a minimum so that the ink ejection quantity becomes minimum.

In Non-Driving shown in FIG. 32(*e*), the driving pulse is applied to the main electrode 10, the sub-electrode 101, the second sub-electrode 102 and the diaphragm (common electrode) 51 so that those electrodes are in the same potential. As a result, the diaphragm 51 is prevented from displacement, so that a non-driving state is obtained.

Figure 33:
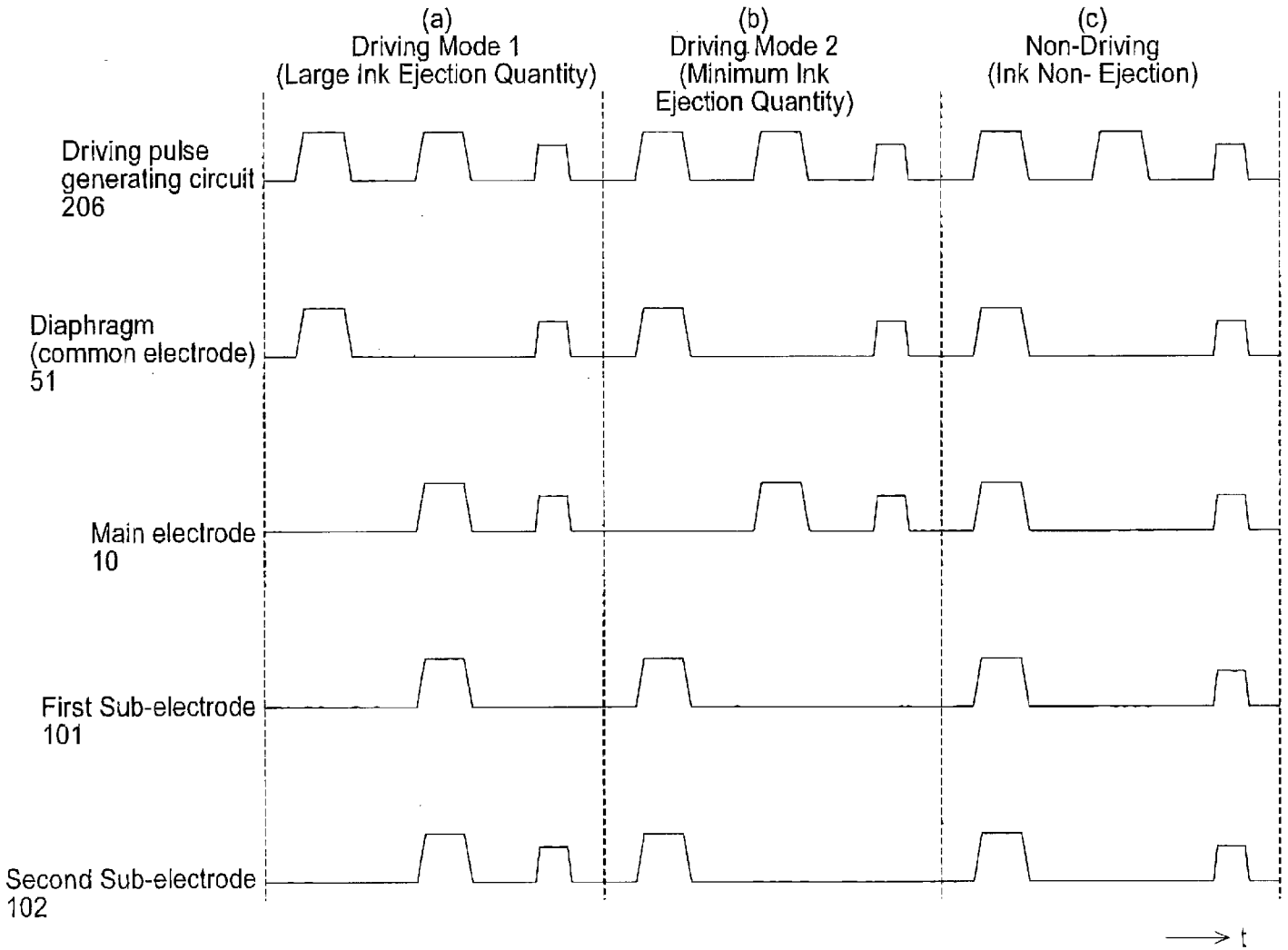
FIG. 33 is a timing chart showing an example of driving modes for the ink jet head according to the fifth embodiment.

FIG. 33 is a timing chart showing an example of driving modes. In these modes, the driving patterns in FIG. 32 are combined by way of example. Here is shown particularly a waveform of a driving pulse for the case where a tail portion (rear end) of an ink column is cut in the same manner as in the embodiment shown in FIG. 9.

In Driving Mode 1 (Large Ink Ejection Quantity) shown in FIG. 33(*a*), the main electrode 10, the sub-electrode 101 and the second sub-electrode 102 are driven simultaneously so as to function as one opposed electrode. As a result, the whole surface of the diaphragm 51 is bent so that the displacement volume of the diaphragm 51 becomes maximum. At a predetermined time after ejecting an ink droplet, the diaphragm 51 is driven so that the diaphragm 51 corresponding to the sub-electrode 101 is bent to cut a tail portion (rear end) of an ink column (see FIG. 29).

In Driving Mode 2 (Very Small Ink Ejection Quantity) shown in FIG. 33(*b*), the main electrode 10 of the ink jet head is driven so that the diaphragm 51 corresponding to the main electrode 10 is displaced. As a result, the displacement volume of the diaphragm 51 becomes minimum. At a predetermined time after ejecting an ink droplet (twice in this example), the sub-electrode 101 and the second sub-electrode 102 are driven so that the diaphragm 51 corresponding thereto is bent to cut a tail portion (rear end) of an ink column (see FIG. 31). The quantity of the ink column to be cut is larger than that when only the sub-electrode 101 is driven. As a result, the ink ejection quantity is smaller than that in Driving Mode 1 described above.

In Non-Driving (Ink Non-Ejection) shown in FIG. 33(*c*), the main electrode 10, the sub-electrode 101, the second sub- electrode 102 and the diaphragm (common electrode) 51 are set to be in the same potential, so that a non-driving state is obtained.

As has been described above, in this embodiment, a second sub-electrode is further formed as a sub-electrode. In addition, the time constant of the circuit constituted by the main electrode 10 and the diaphragm (common electrode) 51, the time constant of the circuit constituted by the sub-electrode 101 and the diaphragm (common electrode) 51, and the time constant of the circuit constituted by the second sub-electrode 102 and the diaphragm (common electrode) 51 are designed to satisfy the above-mentioned conditions (1) to (7). Accordingly, the time delay of electric charging of the electrodes 10, 101 and 102 and the operation caused thereby are eliminated. As a result, if the electrodes are controlled in a desired combination, the control timing thereof is obtained easily so that the diaphragm can be controlled stably. As a result, production of surplus ink droplets is effectively prevented in the ink jet head, so that the reliability of an ink jet printer can be ensured.

In addition, since the second sub-electrode 102 is provided as an opposed electrode other than the main electrode 10 and the sub-electrode 101, the ink ejection quantity can be further controlled in multiple stages, so that the printing density can be adjusted in multiple stages easily. It is therefore possible to perform printing in accordance with a printing medium (sheet/paper/recycled paper) or a printing mode (bar code/character/graphic/photograph/ink save), so that it is possible to enhance the printing quality easily.

Incidentally, although the above-mentioned embodiment has been described about an example in which the second sub-electrode 102 is constituted by one electrode, it may be constituted by two or more electrodes. In that case, it is possible to adjust the printing density easily in more stages.

Embodiment 6

Figure 35:
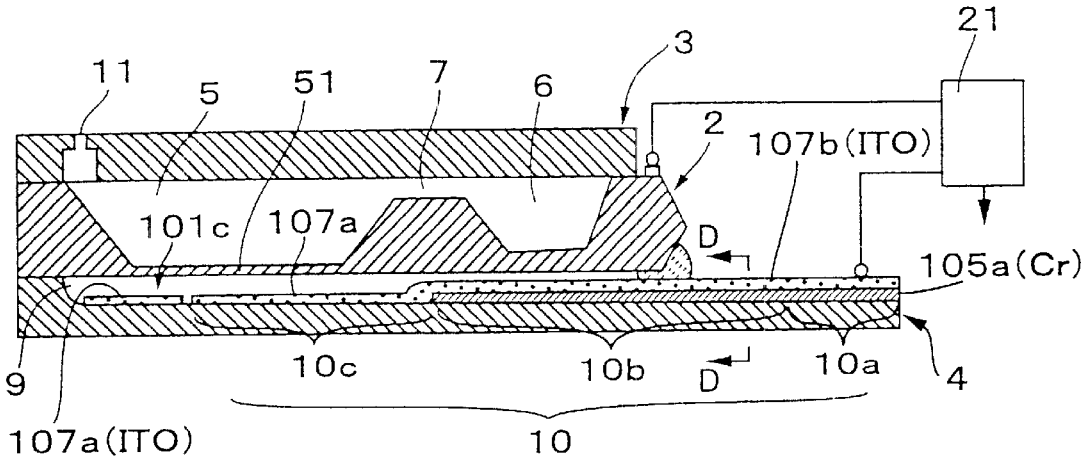
FIG. 35 is a partially sectional view of an ink jet head according to the sixth embodiment of the present invention.
Figure 36:
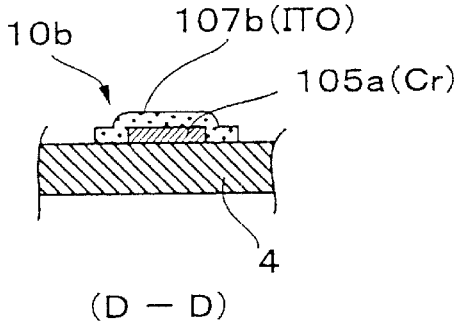
FIG. 36 is a partially sectional view taken along line D—D of FIG. 35.

FIG. 35 is a partially sectional view of an ink jet head of a sixth embodiment according to the present invention, and FIG. 36 is a partially cross-sectional view taken along line D—D in FIG. 35. An ink jet head according to this embodiment has the same configuration as those of the above-mentioned embodiments, and portions corresponding to those of the above-mentioned embodiments are denoted by the same reference numerals in FIGS. 35, 36 and explanation thereof will be omitted.

In this embodiment, a main electrode 10 and a sub-electrode 101 have terminal portions 10*a*, 101*a* and lead portions 10*b* and 10*b*, respectively, constituted by a chromium thin film 105 and an ITO thin film 107*b* coated thereon. The planar layout of the main electrode 10 and the sub-electrode 101 may be either one employed in the above-mentioned embodiments, and that in the first embodiment (see FIG. 2) is employed for this embodiment.

More specifically, the main electrode 10 and the sub-electrode 101 each has an opposed electrode portion formed of a single layer of an ITO thin film 107*a*. Whereas, the terminal and lead portions 10*a*, 101*a* and 10*b*, 101*b* of these electrodes 10, 101 are of the two-layered structure comprising the chromium thin film 105*a* and the ITO thin film 107*b* laminated thereon, in which the chromium thin film 105*a* is coated by the ITO thin film 107*b*. The both ITO thin films 107*a* and 107*b* are the integral one formed at the same manufacturing process which will be explained hereinafter.

Effects or advantages obtained by this embodiment will be explained. First, the ITO thin film 107*b* is formed on the glass substrate via the chromium thin film 105*a* when forming the terminal and lead portions 10*a*, 101*a* and 101*b*, of the electrodes 10 and 101. Hence, these terminal and lead portions are hardly peeled off from the glass substrate 4.

Second, since the chromium thin film 105*a*, or the metal thin film is employed to form the terminal and lead portions 10*a*, 101*a* and 10*b*, 101*b* of the resistance values of the respective portions are decreased. This enables to decrease the time constants of circuits associated with the main electrode 10 and the sub-electrode 101, whereby speed of response of the circuits can be improved, and the wiring pitch of the main electrode and the sub-electrode can be made fine.

Third, the continuous ITO thin film is formed across the opposed electrodes 10 and the read portion 10*b*, and across the opposed electrode portion 101*c* and the lead portion 101*b*, so that the connecting portion between them can be reduced in resistance, and at the same time the reliability of the connecting portion can also be improved.

Fourth, the chromium thin film 105*a*, which is metal and is a constitutional element of the terminal and lead portions 10*a*, 101*a* and 10*b*, 101*b* of the electrodes 10 and 101 exposed outside, is coated with the ITO thin film 107*b*. Therefore, different from the case where a metal film is exposed outside directly, it is possible to prevent the electrodes from operational malfunction due to corrosion, migration or the like. Here, the corrosion may occur when the metal electrode is left outside. The migration means short circuiting between the electrodes arranged adjacent with each other during operation.

In addition, since the opposed electrode portions 10*c* and 10*c* are formed of the ITO thin film 107*a*, insulation breakdown caused by contacting the diaphragm 51 with the electrode 10 or 101, or adhesion of the electrode 10 or 101 to the diaphragm 51 is hardly occurred.

Furthermore, since the opposed electrode portions 10*c* and 101*c* are formed of the ITO thin film 107*a*, the electrostatic actuator constituted between the electrode portions and the diaphragm 51 becomes visible. Thus, through the glass substrate, it is possible to observe whether or not there are any contaminants in the sealed actuator and to observe unevenness of distance between the opposed electrode portion and the diaphragm 51.

On the other hand, the chromium thin film 105*a* may be substituted by a titanium thin film. Likewise, the chromium thin film 105*a* may also be substituted by an alloy of silver, palladium and copper.

Now, an example of the manufacturing process of the main electrode 10 will be described with reference to FIGS.

37 and 38. It is noted that the sub-electrode 101 can be manufactured by the same process as that of the main electrode 10, and therefore explanation of its process will be omitted.

Figure 37:
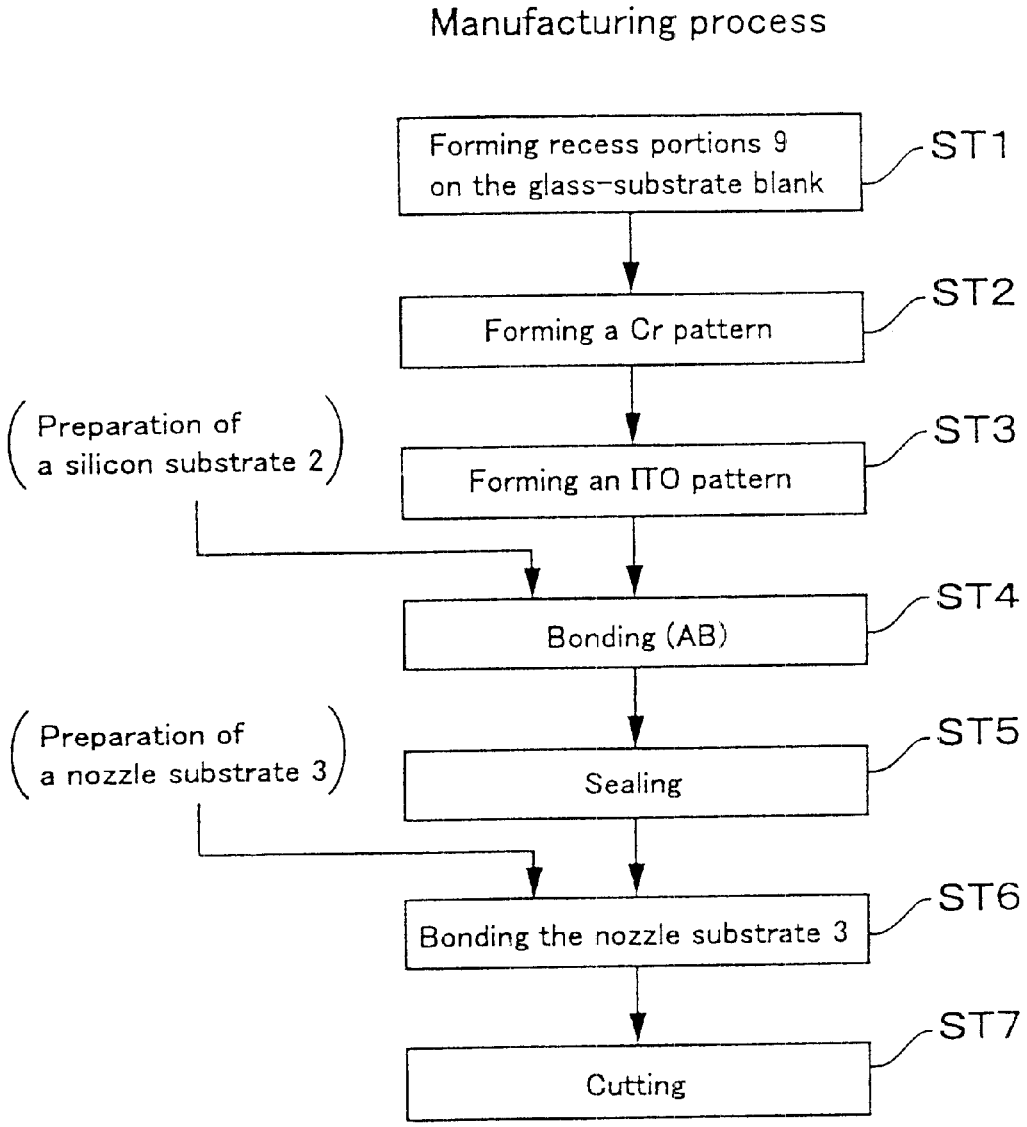
FIG. 37 is a general flow chart illustrating manufacturing process of the ink jet head of the sixth embodiment according to the present invention.

FIG. 37 is a general flow chart illustrating manufacturing process of the ink jet head according to the sixth embodiment, and FIG. 38 is a chart in which details of the main steps 1 to 4 of FIG. 37 and their manufacturing conditions are listed.

Referring to these drawings, at first, a glass-substrate blank is subject to etching on its surface which is to be bonded to the silicon substrate 2, whereby shallow (about 0.3 μm deep, for example) recess portions 9 are formed on its surface portions corresponding to the respective ink chambers 5 of the silicon substrate 2 (Step ST1). In this step, the glass-substrate blank is spattered on its surface with chromium and is formed with a thin (about 0.03 μm thick, for example) chromium film. The surface of the blank formed with the chromium thin film is then coated with a resist film, and subject to exposure to light and developing. Thereafter, the thin chromium film is etched by an etching agent of cerium nitrate to form a mask pattern of the thin chromium film. Then, an HF etching agent is employed to wet etch the surface of the glass-substrate blank to form the recess portions 9, after which the masking chromium thin film is etched from the surface of the blank.

Next, the bottom surface of the recess portion 9 of the blank is formed with a chromium thin film 105*a* as a constitutional element of the terminal and lead portions 10*a*, 10*b* of the main electrode 10 (Step ST2).

In this step, the same process is employed as that forming the masking chromium thin film for the recess portions 9. Namely, the bottom surface of each recess portion 9 of the blank is spattered with chromium to form a chromium thin film (0.03 μm thick, for example). The spatterd chromium thin film is coated with a resist film, and then is subject to exposure to light and developing. Thereafter, portions of the thin chromium film except for those forming the terminal and lead portions 10*a* and 10*b* are applied with an etching agent of cerium nitrate and are etched off. As a result, the chromium thin films 105*a* are formed for the terminal and lead portions 10*a* and 10*b*.

Thereafter, the bottom surface of each recess portion 9 is spattered with ITO to form an ITO thin film, which is then applied with aqua regia and is etched except for its portions forming the opposed electrode portion 10*c*, lead portion 10*b* and terminal portion 10*a*. Whereby, patterning of the ITO thin films 107*a* 107*b* is formed (Step ST3). As a result, the glass substrate 4 is obtained which has the chromium thin film 105*a* coated with the ITO thin film 107*b* as shown in FIGS. 35 and 36.

After the main electrode 10 is patterned on the bottom surface of the recess portion 9 as mentioned above, the glass-substrate 4 is anodic-bonded with the silicon-substrate 2 which has been separately manufactured (Step ST4). Sealing material is then used to form the air-tight sealing portion 23 (Step ST5). Then, a nozzle-substrate 3 which has been separately manufactured is laminated and bonded to the assembly of the glass substrate 4 and the silicon-substrate 2 (Step ST6), and thereafter the assembly of the three substrates is cut off to obtain individual ink jet heads of the same configuration (Step ST 7).

According to the thus manufactured ink jet head of this embodiment, the same patterning process can be employed for forming the chromium thin film 105*a* of the electrodes 10 and 101 on the bottom surface of each recess portion 9 (Step ST2 in FIG. 35) and for forming the masking chromium thin film on the surface of the glass-substrate blank to form the recess portions 9 (Step ST1 in FIG. 35). Therefore, the electrodes 10,101 can easily be reduced in their resistance without causig the manufacturing process complicated.

Where the chromium thin film 105*a* is substituted by a titanium thin film, titanium instead of chromium is spattered to form a titanium thin film instead of the chromium thin film in Step ST2 of FIG. 35, wherein the titanium thin film is coated with a resist film, which in turn is subject to exposure to light and developing, and removed of its portions corresponding to the terminal and lead portions 10*a* and 10*b*1, and then the titanium thin film is spattered. Thereafter, the resist film is dissolved and unnecessary titanium thin film portions are removed, whereby the titanium thin film is obtained for constituting the terminal and lead portions 10*a* and 10*b* instead of the chromium thin film 105*a*. This manufacturing process of the titanium thin film is referred to as "lift off" hereinafter.

Forming the titanium thin film by lift off process instead of forming the chromium thin film 105*a*, makes it possible to form the wiring which exhibits excellent corrosion-resistant and adhesive properties.

On the other hand, when an alloy of silver, palladium and copper (referred to as "APC" hereinafter) is employed instead of the chromium thin film 105*a*, APC is spattered and is subject to lift off process or etching by ferric chloride solution to thereby form APC thin film for constituting the terminal and lead portions 10*a* and 10*b* instead of the chromium thin film 105*a*.

Forming the thin alloy film composed of silver, palladium and copper instead of the chromium thin film 105*a* enables to form a very fine wiring having a lower resistance.

Embodiment 7

The above-mentioned embodiments have been described about examples where the number of ink nozzles is 64, as shown in FIG. 20. In the present invention, an ink jet head is designed to be driven by electric charge/discharge between the opposed electrodes and the diaphragms (common electrode), so that the power consumed for driving the ink jet head is very low. Even if an ink jet head is constituted by a larger number of nozzles, the power consumed by the head as a whole is so low that there is a further effect that low power consumption can be realized.

For example, in the case where the number of nozzles in an ink jet head is 1,000, the 1,000 nozzles are arranged in a line, and ink chambers of the same number as that of ink nozzles are demarcated and formed likewise in a line. The above-mentioned sub-electrodes are also disposed in a line. With such a configuration, it is possible to obtain a linear ink jet head. According to the present invention, even if such a linear ink jet head is formed, the number of wires for driving the sub-electrodes is reduced. In addition to the effects shown in the above-mentioned embodiments, it is possible to realize a linear ink jet head which is low in power consumption, and small in size.

Embodiment 8

Figure 34:
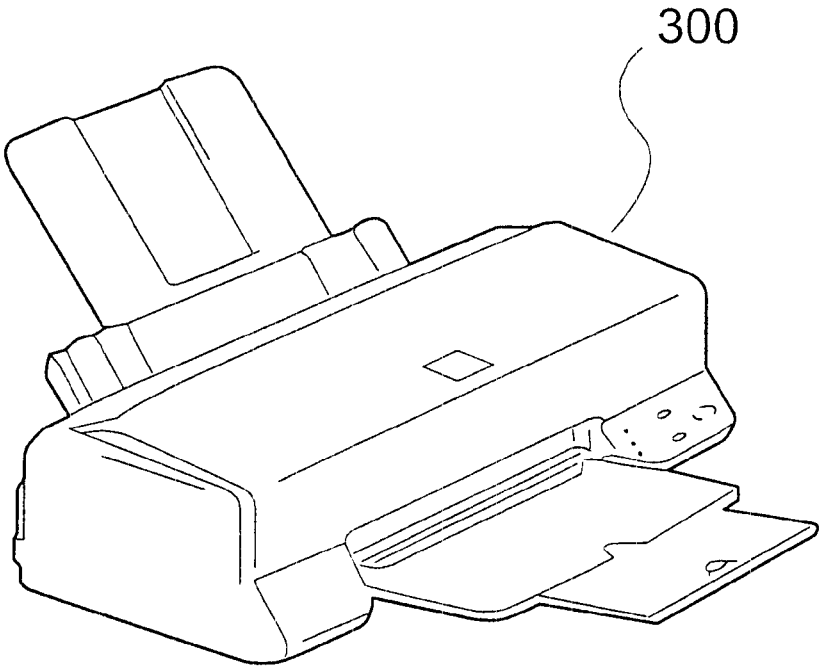
FIG. 34 is a perspective view of an ink jet printer mounted with an ink jet head according to the above-mentioned embodiments.

FIG. 34 is a perspective view of a printer 300 mounted with an ink jet head 1 according to the above-mentioned embodiments. In this printer 300, it is possible to realize a printer having the advantages of the ink jet head 1 according to the above-mentioned embodiments.

While the invention has been described in conjunction with specific embodiments, many further alternatives, modifications, applications and variations, including those described above, will be apparent to those skilled in the art in light of the foregoing description. Thus, the invention described herein is intended to embrace all such alternatives, modifications, applications and variations as may fall within the spirit and scope of the appended claims.

What is claimed is:

1. An ink jet head comprising:

a plurality of ink nozzles for ejecting ink;

a plurality of ink chambers respectively communicating with a corresponding one of said ink nozzles;

ink supply channels respectively supplying ink to a corresponding one of said ink chambers;

elastically deformable diaphragms respectively formed in a wall of a corresponding one of said ink chambers; and a plurality of sets of electrodes for ejecting ink droplets from said ink nozzles by charging between said electrodes and said diaphragms and discharging therefrom;

wherein each of said sets of electrodes comprises a main electrode opposing a corresponding one of said diaphragms with a first gap therebetween, said main electrode separated from the other main electrodes for the other diaphragms so as to charge between said main electrode and the corresponding diaphragm independently of the other main electrodes for the other diaphragms, and a sub-electrode opposing a corresponding one of said diaphragms with a second gap therebetween, said sub-electrode electrically connected with other sub-electrodes for the other diaphragms.

2. An ink jet head according to claim 1, wherein each main electrode and the corresponding diaphragm form a set of first capacitors, each first capacitor being selectively charged and discharged in accordance with a printing pattern, and wherein each sub-electrode and the corresponding diaphragm form a set of second capacitors.

3. An ink jet head according to claim 2, wherein each of said main and sub-electrodes includes an opposed portion formed of ITO and oppositely disposed to said diaphragms, and a lead portion electrically connected with said opposed portion, and wherein at least said lead portion is formed of metal.

4. An ink jet head according to claim 3, wherein said metal is composed of gold formed on chromium or titanium.

5. An ink jet head according to claim 3, wherein said metal is formed of chromium, titanium, aluminum, or platinum.

6. An ink jet head according to claim 2, wherein each of a first time constant of a circuit constituted by said first capacitor and a second time constant of a circuit constituted by said second capacitor is much smaller than a natural vibration period of the corresponding one of said ink channels.

7. A method for driving an ink jet head as defined in claim 2 so that ink droplets are ejected from said ink nozzles, comprising the step of charging/discharging said second capacitors so that ink in said ink nozzles is vibrated.

8. A method for driving an ink jet head as defined in claim 2, comprising the steps of:

charging/discharging said first capacitors so as to eject ink droplets from said ink nozzles; and charging/discharging said second capacitors so that said ink droplets ejected from said ink nozzles are separated from ink remaining in said ink chambers.

9. A method for driving an ink jet head as defined in claim 2, comprising the step of charging/discharging said first capacitors so as to eject ink droplets in succession from said ink nozzles, wherein said first capacitors are charged when a following ink droplet is ejected immediately after ejecting a previous ink droplet so that said previous ink droplet is separated from ink remaining in said ink chambers.

10. A method for driving an ink jet head as defined in claim 2, comprising the steps of charging/discharging said first capacitors in combination with said second capacitors for controlling an amount of ink droplets ejected from said ink nozzles.

11. An ink jet head according to claim 2, wherein each of said main and sub-electrodes includes an opposed portion formed of ITO and oppositely disposed to said diaphragms, and a lead portion electrically connected with said opposed portion, and wherein at least said lead portion comprises a metal thin film and an ITO thin film formed on said metal thin film.

12. An ink jet head according to claim 11, wherein said metal thin film is formed of chromium, titanium, silver, or an alloy thereof.

13. An ink jet head according to claim 1, wherein said first gap is different than said second gap.

14. An ink jet head according to claim 13, wherein said first gap is larger than said second gap.

15. An ink jet head according to claim 1, wherein each of said sub-electrodes includes a first sub-electrode commonly provided for said plurality of diaphragms so as to face said diaphragms on an ink nozzle side, and one or a plurality of second sub-electrodes commonly provided for a plurality of said diaphragms so as to be disposed between said main electrode and said first sub-electrode.

16. An ink jet head according to claim 1, further comprising a plurality of units each having a predetermined number of main electrodes and sub-electrodes, provided for a predetermined number of said diaphragms.

17. An ink jet head according to claim 16, wherein every adjacent two units are disposed to be symmetrical with respect to a boundary line between said two adjacent units.

18. An ink jet printer having an ink jet head, said head comprising:

a plurality of ink nozzles for ejecting ink;

a plurality of ink chambers respectively communicating with a corresponding one of said ink nozzles;

ink supply channels respectively supplying ink to a corresponding one of said ink chambers;

elastically deformable diaphragms respectively formed in a wall of a corresponding one of said ink chambers; and a plurality of sets of electrodes for ejecting ink droplets from said ink nozzles by charging between said electrodes and said diaphragms and discharging therefrom;

wherein each of said sets of electrodes comprises a main electrode opposing a corresponding one of said diaphragms with a first gap therebetween, said main electrode separated from the other main electrodes for the other diaphragms so as to charge between said main electrode and the corresponding diaphragm independently of the other main electrodes for the other diaphragms, and a sub-electrode opposing a corresponding one of said diaphragms with a second gap therebetween, said sub-electrode electrically connected with other sub-electrodes for the other diaphragms.

19. An ink jet printer according to claim 18, wherein each main electrode and the corresponding diaphragm form a set of first capacitors, each first capacitor being selectively charged and discharged in accordance with a printing pattern, and wherein each sub-electrode and the corresponding diaphragm form a set of second capacitors.

20. An ink jet printer according to claim 19, further comprising:

a main electrode driving circuit for electrically charging/discharging said first capacitors so that ink droplets are ejected from said ink nozzles; and a sub-electrode driving circuit for electrically charging/discharging said second capacitors in a predetermined period or at a predetermined time so that ink in said ink nozzles is vibrated.

21. An ink jet printer according to claim 19, comprising:

a main electrode driving circuit for electrically charging/discharging said first capacitors that ink droplets are ejected from said ink nozzles; and a sub-electrode driving circuit for electrically charging/discharging said second capacitors at a predetermined time after discharging said first capacitors, so that ink ejected from said ink nozzles is separated from ink remaining in said ink chambers.

* * * * *